US008132630B2

(12) United States Patent
Krueger et al.

(10) Patent No.: US 8,132,630 B2
(45) Date of Patent: Mar. 13, 2012

(54) REVERSE CIRCULATION PRESSURE CONTROL METHOD AND SYSTEM

(75) Inventors: Sven Krueger, Winsen/Aller (DE); Volker Krueger, Celle (DE); Jens Bruns, Niedersachsen (DE); Roger Fincher, Conroe, TX (US); Larry Watkins, Houston, TX (US); Peter Aronstam, Houston, TX (US); Peter Fontana, Buenos Aires (AR)

(73) Assignee: Baker Hughes Incorporated, Houston, TX (US)

( * ) Notice: Subject to any disclaimer, the term of this patent is extended or adjusted under 35 U.S.C. 154(b) by 496 days.

(21) Appl. No.: 11/693,574

(22) Filed: Mar. 29, 2007

(65) Prior Publication Data

US 2007/0278007 A1 Dec. 6, 2007

Related U.S. Application Data

(60) Provisional application No. 60/787,128, filed on Mar. 29, 2006.

(51) Int. Cl.
*E21B 21/08* (2006.01)

(52) U.S. Cl. ..... 175/25; 175/38

(58) Field of Classification Search ..... 175/5, 7, 175/25, 38, 57, 213, 217
See application file for complete search history.

(56) References Cited

U.S. PATENT DOCUMENTS 4,108,257 A * 8/1978 Sizer ..... 175/230
4,137,975 A 2/1979 Pennock
4,223,747 A 9/1980 Marais
4,310,058 A * 1/1982 Bourgoyne, Jr. ..... 175/48
4,311,197 A * 1/1982 Hushbeck ..... 166/373
4,368,787 A 1/1983 Messenger
4,682,661 A 7/1987 Hughes et al.
5,497,839 A 3/1996 Moir
5,586,609 A 12/1996 Schuh
6,102,139 A 8/2000 Tibussek et al.
6,457,529 B2 10/2002 Calder et al.
6,505,691 B2 1/2003 Judge et al.
6,629,570 B1 * 10/2003 Head ..... 175/61
6,719,071 B1 * 4/2004 Moyes ..... 175/65
6,854,534 B2 2/2005 Livingstone
6,892,829 B2 5/2005 Livingstone
6,904,982 B2 6/2005 Judge et al.
7,055,627 B2 6/2006 Fontana et al.
7,090,018 B2 * 8/2006 Livingstone ..... 166/312
2004/0050589 A1 3/2004 Head
2004/0112643 A1 6/2004 Chan et al.
2004/0154805 A1 * 8/2004 Fontana et al. ..... 166/358
2005/0061546 A1 3/2005 Hannegan
2006/0060385 A1 3/2006 Amaudric Du Chaffaut et al.

* cited by examiner

*Primary Examiner* — Daniel P Stephenson

(74) *Attorney, Agent, or Firm* — Mossman, Kumar & Tyler PC

(57) ABSTRACT

A system for reverse circulation in a wellbore includes equipment for supplying drilling fluid into the wellbore bit via at least an annulus of the wellbore and returning the drilling fluid to a surface location via at least a bore of a wellbore tubular. The system also includes devices for controlling the annulus pressure associated with this reverse circulation. An active pressure differential device may increase the pressure wellbore annulus to at least partially offset a circulating pressure loss. Alternatively, the system may include devices for decreasing the pressure in the annulus of the wellbore.

14 Claims, 17 Drawing Sheets

REVERSE CIRCULATION PRESSURE CONTROL METHOD AND SYSTEM

CROSS-REFERENCE TO RELATED APPLICATIONS

This application takes priority from U.S. Provisional Patent Application Ser. No. 60/787,128, filed Mar. 29, 2006.

BACKGROUND OF THE DISCLOSURE

1. Field of the Disclosure

This disclosure relates generally to oilfield wellbore drilling systems and more particularly to drilling fluid circulation systems that utilize a wellbore fluid circulation device to optimize drilling fluid circulation.

2. Background of the Art

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling with conventional drilling fluid circulation systems, the drilling operator attempts to carefully control the fluid density at the surface so as to control pressure in the wellbore, including the bottomhole pressure. Referring to FIG. 1A, there is shown a surface pump P1 at the surface S1 for pumping a supply fluid SF1 via a drill string DS1 into a wellbore W1. The return fluid RF1 flows up an annulus A1 formed by the drill string DS1 and wall of the wellbore W1. The drilling fluid in the annulus A1 carries with it the cuttings C1 generated by the cutting action of a drill bit (not shown). The drill string DS1 is shown separately from the wellbore W1 to better illustrate the flow path of the circulating drilling fluid. Typically, the operator maintains the hydrostatic pressure of the drilling fluid in the wellbore above the formation or pore pressure to avoid well blow-out. Under this regime, the surface pump P1 has the burden of flowing the drilling fluid down the drill string DS1 and also upwards along the annulus A1. Accordingly, the surface pump P1 must overcome the frictional losses along both of these paths. Moreover, the surface pump P1 must maintain a flow rate in the annulus A1 that provides sufficient fluid velocity to carry entrained cuttings C1 to the surface. Thus, in this conventional arrangement, the pumping capacity of the surface pump P1 is typically selected to (i) overcome frictional losses present as the drilling fluid flows through the drill string DS1 and the annulus A1; and (ii) provide a flow velocity or flow rate that can carry or lift the cuttings C1 through the annulus A1. It will be appreciated that such pumps must have relatively large pressure and flow rate capacities. Furthermore, these relatively large pressures can damage the exposed formation F1 (or "open hole") below the casing CA1. For instance, the fluid pressure needed to provide the desired fluid flow rate can fracture the rock or earth forming the wall of the wellbore W1 and thereby compromise the integrity of the wellbore W1 at the exposed and unprotected formation F1.

In another conventional drilling arrangement shown in FIG. 1B, there is shown a pump P2 at the surface for pumping a supply fluid SF2 via an annulus A2 into a wellbore W2. The return fluid RF2 flows up the drill string DS2 carrying with it the entrained cuttings C2. In this regime, the surface pump P2 also has the burden of flowing the drilling fluid down the drill string DS2 and also upwards along the annulus A2. Accordingly, the surface pump P2 must overcome the frictional losses along both of these paths. Further, because the cross-sectional area of the drill string DS2 is smaller than the cross sectional area of the annulus A2, the density of the return fluid RF2 and cuttings C2 flowing in the drill string DS2 is higher than the density of the return fluid RF1 and cuttings in the annulus A1 of FIG. 1A under similar drilling conditions (e.g., the same rate of penetration (ROP)). This higher fluid density requires a correspondingly higher pressure differential and flow rate in order to lift the cuttings C2 to the surface S2. Thus, in this conventional arrangement, the pumping capacity of the surface pump P2 is typically selected to (i) overcome frictional losses present as the drilling fluid flows through the annulus A and the drill string DS2; and (ii) provide a flow velocity or flow rate that can carry or lift the cuttings C2 through the annulus A2. It will be appreciated that such pumps must also have relatively large pressure and flow rate capacities.

The present disclosure addresses these and other drawbacks of conventional fluid circulation systems for supporting well construction activity.

SUMMARY OF THE DISCLOSURE

The present disclosure provides wellbore systems for performing downhole wellbore operations for both land and offshore wellbores. Such drilling systems include a rig that moves an umbilical (e.g., drill string) into and out of the wellbore. A bottomhole assembly, carrying the drill bit, is attached to the bottom end of the drill string. A well control assembly or equipment on the wellhead receives the bottomhole assembly and the umbilical. A drilling fluid system supplies a drilling fluid via a fluid circulation system having a supply line and a return line. During operation, drilling fluid is fed into the supply line, which can include an annulus formed between the umbilical and the wellbore wall. This fluid washes and lubricates the drill bit and returns to the well control equipment carrying the drill cuttings via the return line, which can include the umbilical.

A system for reverse circulation in a wellbore include equipment for supplying drilling fluid into the wellbore bit via at least an annulus of the wellbore and returning the drilling fluid to a surface location via at least a bore of a wellbore tubular. The system also includes devices for controlling the annulus pressure associated with this reverse circulation. In one embodiment, an active pressure differential device increases the pressure wellbore annulus to at least partially offset a circulating pressure loss. In other embodiments, the system includes devices for decreasing the pressure in the annulus of the wellbore. For offshore application, annulus pressure is decreased to accommodate the pore and fracture pressures of a subsea formation. In still other embodiments, annulus pressure is decreased to cause an underbalanced condition in the well.

In one embodiment of the present disclosure, a fluid circulation device, such as a positive displacement or centrifugal pump, positioned along the return line provides the primary motive force for circulating the drilling fluid through the supply line and return line of the fluid circulation system. By "primary motive force," it is meant that operation of the fluid circulation device provides the majority of the force or differential pressure required to circulate drilling fluid through the supply line and return line. In other embodiments of the present disclosure, a downhole fluid circulation device does not provide the primary motive force to circulate drilling fluid through the supply line and return line.

Examples of the more important features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the preferred embodiment, taken in conjunction with the accompanying drawing.

DETAILED DESCRIPTION OF PREFERRED EMBODIMENTS

Figure 2:
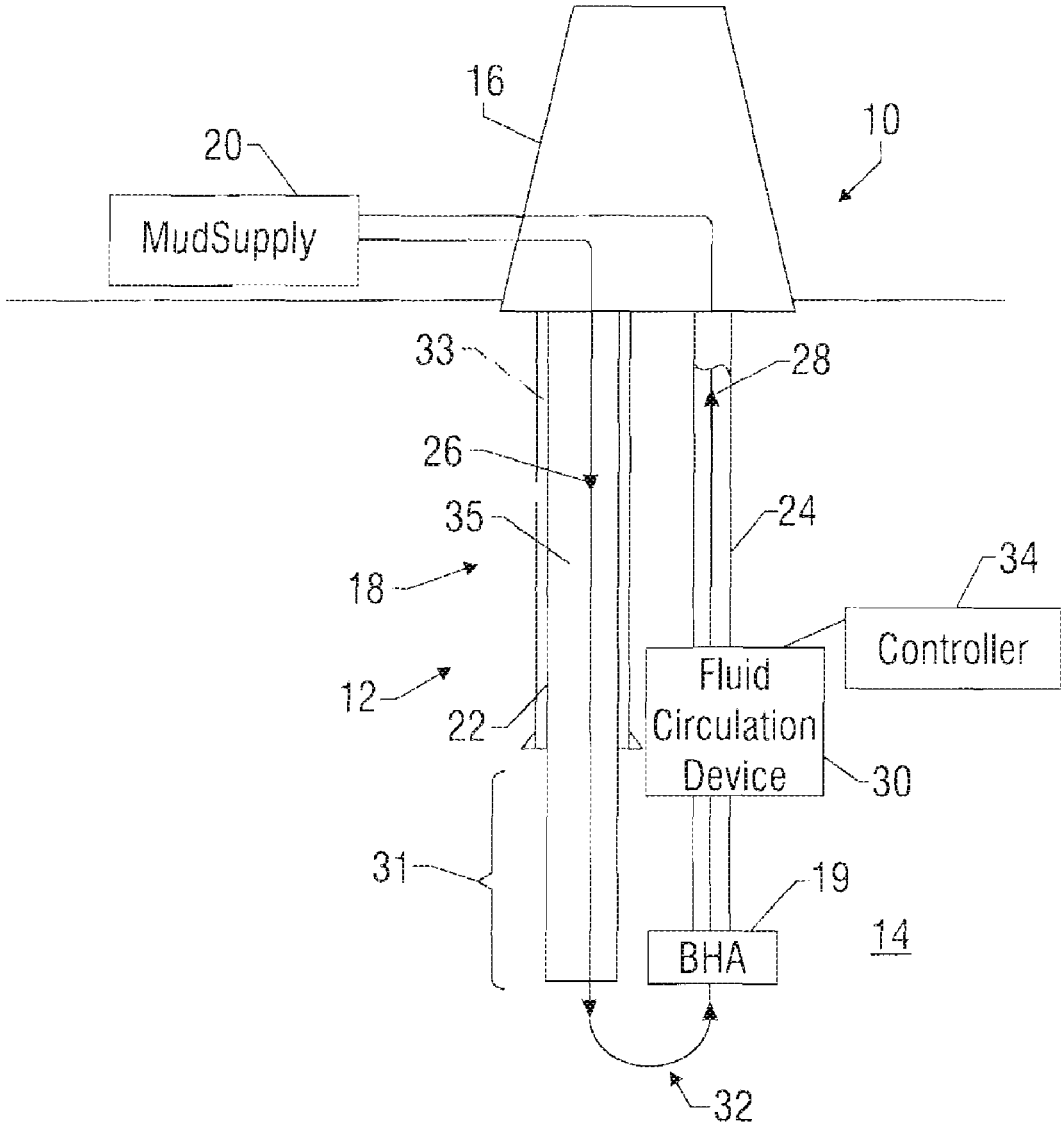
FIG. 2 is a schematic illustration of an exemplary arrangement for circulating fluid in a wellbore according to one embodiment of the present disclosure.

Referring initially to FIG. 2, there is schematically illustrated a well construction facility 10 for forming a wellbore 12 in an earthen formation 14. The facility 10 includes a rig 16 and known equipment such as a wellhead, blow-out preventers and other components associated with the drilling, completion and/or workover of a hydrocarbon producing well. For clarity, these components are not shown. Moreover, the rig 16 may be situated on land or at an offshore location. In accordance with one embodiment of the present disclosure, the facility 10 includes a fluid circulation system 18 for providing drilling fluid to a downhole tool or drilling assembly 19. One exemplary fluid circulation system 18 includes a surface mud supply 20 that provides drilling fluid into a supply line 22. This drilling fluid circulates through the wellbore 12 and returns via a return line 24 to the surface. For clarity, the downward flow of drilling fluid is identified by arrow 26 and the upward flow of drilling fluid is identified by arrow 28. The term "line" as used in supply line 22 and return line 24 should be construed in its broadest possible sense. A line can be formed of one continuous conduit, path or channel or a series of connected conduits, paths or channels suitable for conveying a fluid. The line can be co-axial or concentric with another line and include cross-flow subs. Moreover, the line can include man-made sections (tubulars) and/or earthen sections (e.g., an annulus). Conventionally, a casing 33 for providing structural integrity is installed in at least a portion the wellbore 12, the portion below the casing 33 being generally referred to as "open hole" or exposed formation 31. During drilling, the drilling fluid flowing uphole, shown by arrow 28, will have entrained rock and earth formed by a drill bit (also referred to as "return fluid"). In one exemplary arrangement, the supply line 22 can include an annulus 35 of the wellbore 12 and the return line 24 can include drill string, a coiled tubing, a casing, a liner, an umbilical, and/or other tubular member connecting a downhole tool, bottomhole assembly, or drilling assembly 19 to the rig 16.

In one embodiment, a fluid circulation device 30 is positioned in the return line 24 above or uphole of a well bottom 32. The fluid circulation device 30 provides the primary motive force for causing drilling fluid to flow or circulate down through the supply line 22 and up through the return line 24. By "primary motive force," it is meant that operation of the fluid circulation device provides the majority of the force or pressure differential required to circulate drilling fluid through the supply line 22, the BHA 19 and return line 24. In one arrangement, the operation of the fluid circulation device 30 is substantially independent of the operation of the drill bit (not shown) of the BHA 19. For example, the flow rate or pressure differential provided by the fluid circulation device 30 can be controlled without having to alter drill bit rotation (RPM). Thus, the operational parameters of the fluid circulation device can be controlled without necessarily reducing or increasing the rotational speed, torque, or other operational parameter of the bit or the drill string rotating the drill bit. Such an arrangement can, for instance, enable circulation of drilling fluid even when the drill bit either does not rotate or rotates a minimal amount. It should be understood that the fluid circulation device can be any device, arrangement, or mechanism adapted to actively induce flow or controlled movement of a fluid body or column. Such devices can include mechanical, electro-mechanical, hydraulic-type systems such as centrifugal pumps, positive displacement pumps, piston-type pumps, jet pumps, magneto-hydrodynamic drives, and other like devices.

Operation of the fluid circulation device 30 creates, in certain arrangements, a pressure differential that causes the otherwise mostly static fluid column in the supply line 22 (along with drill cuttings) to be drawn across the BHA 19 and into the return line 24 at the vicinity of the well bottom 32. To the extent needed to maintain a specified flow rate, the fluid circulation device 30 can increase the flow rate of the fluid in the supply line 22 by increasing the pressure differential in the vicinity of the well bottom 32. The fluid circulation device 30 also provides sufficient "lifting" force to flow the return fluid and entrained cuttings to the surface through the return line 24. It should therefore be appreciated that the fluid circulation device 30 can actively induce fluid circulation in both the supply line 22 and the return line 24.

In one exemplary deployment, the mud supply 20 fills the supply line 22 with drilling fluid by allowing gravity to flow the drilling fluid toward the well bottom 32. Other suitable devices could include small surface pumps for providing pressure necessary to convey the drilling fluid to the inlet of supply line 22. In another exemplary arrangement, supplemental fluid circulation devices (not shown) can be coupled to the supply line 22 and/or return line 24 to assist in circulating drilling fluid. By "supplemental," it is meant that these additional fluid circulation devices circulate drilling fluid to provide a motive force to overcome specific factors but primarily operate in cooperation with the fluid circulation device 30. For example, a supplemental fluid circulation device can be coupled to the supply line 22 to vary the pressure or flow rate in the fluid column in the supply line 22 a predetermined amount; e.g., an amount sufficient to offset circulation losses in the supply line 22. Thus, in contrast to conventional fluid circulation systems, the burden of circulating drilling fluid into and out of the wellbore is taken up by a fluid circulation device disposed in the wellbore along the return line rather than by fluid circulation devices at the surface ends of the supply line 22 and the return line 24.

In certain embodiments, the system 10 can also include a controller 34 for controlling the fluid circulation device 30. An exemplary controller 34 controls the fluid circulation device 30 in response to signals transmitted by one or more sensors (not shown) that are indicative of one or more of: pressure, fluid flow, a formation characteristic, a wellbore characteristic and a fluid characteristic, a surface measured parameter or a parameter measured in the drill string. The controller 34 can include circuitry and programs that can, based on received information, determine the operating parameters that provide optimal drilling conditions (rate of penetration, well bore stability, optimized drilling flow rate, etc.)

Figure 1A:
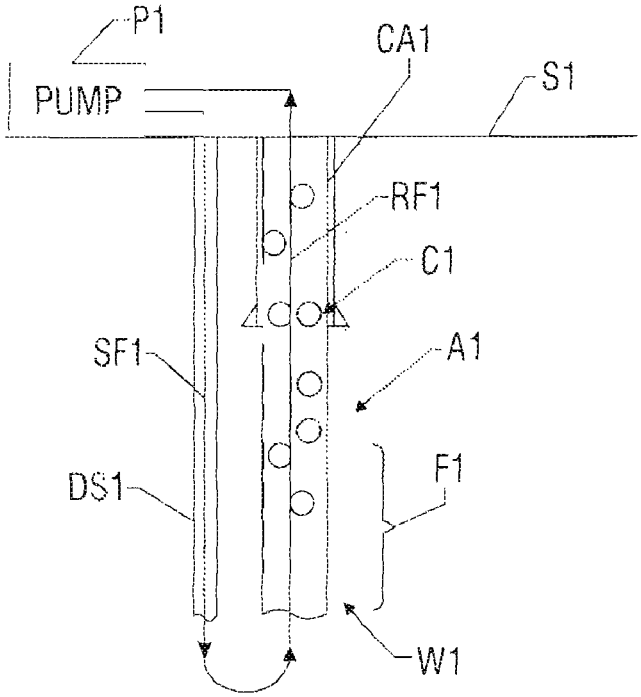
FIG. 1A is a schematic illustration of one conventional arrangement for circulating fluid in a wellbore.
Figure 1B:
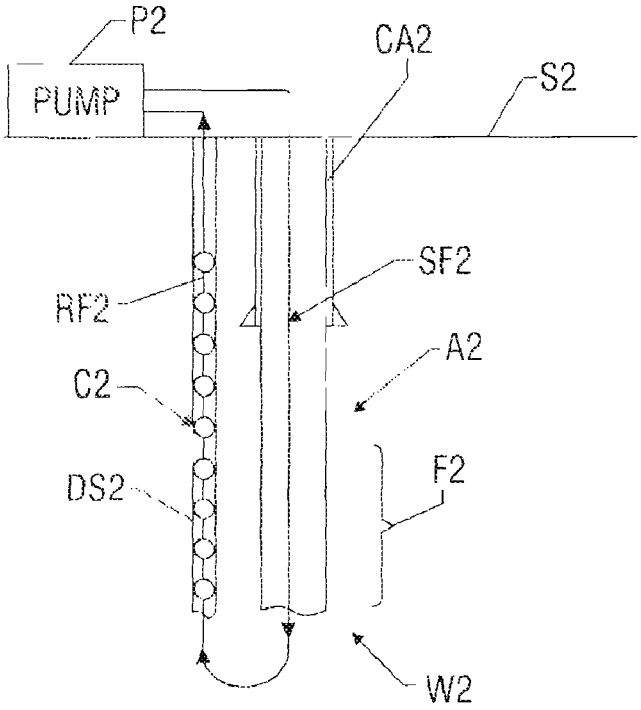
FIG. 1B is a schematic illustration of another conventional arrangement for circulating fluid in a wellbore.

Referring now to FIGS. 1A, 1B and 2, it will apparent to one skilled in the art that the FIG. 2 embodiment of the present disclosure has a number of advantages over conventional drilling fluid circulation systems. First, in contrast to conventional arrangements wherein a surface pump must "push" fluid through both the supply line, the BHA and return line, the fluid circulation device 30, the device for providing the primary motive force for fluid circulation, is strategically positioned in the return line. Thus, the fluid circulation device 30 need only be configured to "push" fluid through the return line. A passive mechanism, such as gravity-assisted flow, can be use to flow drilling fluid along the annulus 35. Thus, because the fluid circulation device 30 actively flows drilling fluid through roughly half of the fluid circuit, the power requirements of the fluid circulation device 30 are reduced to some degree. Additionally, the fluid circulation device 30 primarily acts upon the fluid flowing through the return line 24 (e.g., an umbilical such as a drill string) not on the fluid flowing in the annulus and, in particular, the fluid flowing in the portion exposed to the formation 31. Thus, operation of the fluid circulation device 30 does not increase the fluid pressure in the drilling fluid residing in the open hole section 31 of the wellbore 12. Advantageously, therefore, circulation of drilling fluid is provided in the fluid circuit servicing the wellbore 32 without creating fluid pressures in the annulus 35 that could damage the earth and rock making up the formation. Stated differently, the fluid circulation device 30 is advantageously positioned to allow the primary motive force or differential needed to circulate drilling fluid to act upon fluid confined within the return line 24 so as to maintain a relatively benign pressure in the fluid column in the annulus 34.

The numerous embodiments and adaptations of the present disclosure will be discussed in further detail below.

Figure 3:
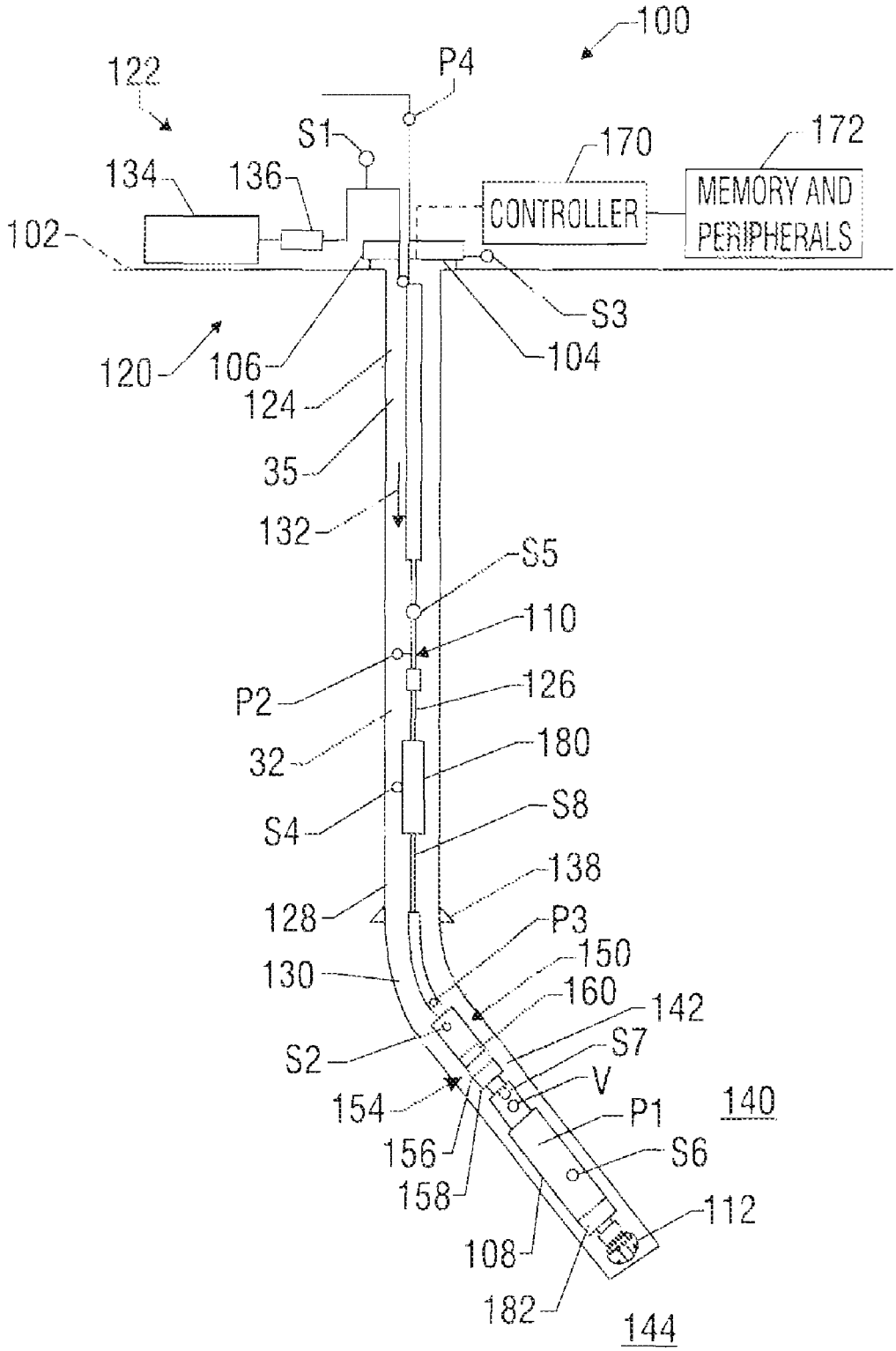
FIG. 3 is a schematic elevation view of well construction system using a fluid circulation device made in accordance with one embodiments of the present disclosure.

Referring now to FIG. 3, there is schematically illustrated a system 100 for performing one or more operations related to the construction, logging, completion or work-over of a hydrocarbon producing well. In particular, FIG. 3 shows a schematic elevation view of one embodiment of a wellbore drilling system 100 for drilling wellbore 32. The drilling system 100 includes a drilling platform 102. The platform 102 can be situated on land or can be a drill ship or another suitable surface workstation such as a floating platform or a semi-submersible for offshore wells. For offshore operations, additional known equipment such as a riser and subsea wellhead will typically be used. To drill a wellbore 32, well control equipment 104 (also referred to as the wellhead equipment) is placed above the wellbore 32. The wellhead equipment 104 includes a blow-out-preventer stack 106 and a lubricator (not shown) with its associated flow control.

This system 100 further includes a well tool such as a drilling assembly or a bottomhole assembly ("BHA") 108 at the bottom of a suitable umbilical such as umbilical 110. In one embodiment, the BHA 108 includes a drill bit 112 adapted to disintegrate rock and earth. The umbilical 110 can be formed partially or fully of drill pipe, metal or composite coiled tubing, liner, casing or other known members. Additionally, the umbilical 110 can include data and power transmission carriers such fluid conduits, fiber optics, and metal conductors. To drill the wellbore 32, the BHA 108 is conveyed from the drilling platform 102 to the wellhead equipment 104 and then inserted into the wellbore 32. The umbilical 110 is moved into and out of the wellbore 32 by a suitable tubing injection system.

In accordance with one aspect of the present disclosure, the drilling system 100 includes a fluid circulation system 120 that includes a surface mud system 122, a supply line 124, and a return line 126. The supply line 124 includes an annulus 35 formed between the umbilical 110 and the casing 128 or wellbore wall 130. During drilling, the surface mud system 122 supplies a drilling fluid to the supply line 124, the downward flow of the drilling fluid being represented by arrow 132. The mud system 122 includes a mud pit or supply source 134. In exemplary offshore configurations, the source 134 can be at the platform, on a separate rig or vessel, at the seabed floor, or other suitable location. In one embodiment, the source 134 is a variable volume tank positioned at a seabed floor. While gravity may be used as the primary mechanism to induce flow through the umbilical 110, one or more pumps 136 may be utilized to assist the flow of the drilling fluid 35. The drill bit 112 disintegrates the formation (rock) into cuttings (not shown). The drilling fluid leaving the drill bit travels uphole through the return line 126 carrying the drill cuttings therewith (a "return fluid"). The return line 126 can convey the return fluid to a suitable storage tank at a seabed floor, to a platform, to a separate vessel, or other suitable location. In one embodiment, the return fluid discharges into a separator (not shown) that separates the cuttings and other solids from the return fluid and discharges the clean fluid back into the mud pit 134 at the surface or an offshore platform.

Once the well 32 has been drilled to a certain depth, casing 128 with a casing shoe 138 at the bottom is installed. The drilling is then continued to drill the well to a desired depth that will include one or more production sections, such as section 140. The section below the casing shoe 138 may not be cased until it is desired to complete the well, which leaves the bottom section of the well as an open hole, as shown by numeral 142.

As noted above, the present disclosure provides a drilling system for controlling bottomhole pressure at a zone of interest designated by the numeral 140 and also optimize drilling parameters such as drilling fluid flow rate and rate of penetration. In one embodiment of the present disclosure, a fluid circulation device 150 is fluidly coupled to return line 126 downstream of the zone of interest 140. The fluid circulation device is device that is capable of inducing flow of fluid in the supply line 124 and the return line 126, such as by creating a pressure differential "ΔP" across the device. Thus, the fluid circulation device 126 produces a sufficient suction pressure at the drill bit 112 to draw in the drilling fluid within the supply line 124 (annulus 91) and "lift" or flow the drilling fluid and entrained cuttings to the surface via the return line 126. Additionally, by producing a controlled pressure drop, the fluid circulation device 150 reduces upstream pressure, particularly in zone 140. The fluid circulation device 150 in certain arrangements can be a suitable pump, e.g., a multi-stage centrifugal-type pump. Moreover, positive displacement type pumps such a screw or gear type or moineau-type pumps may also be adequate for many applications. For example, the pump configuration may be single stage or multi-stage and utilize radial flow, axial flow, or mixed flow.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the umbilical 110 and/or the annulus 35. FIG. 1A shows an exemplary flow-control device 152 that includes a device 154 that can block the fluid flow within the umbilical 110 and a device 156 that blocks can block fluid flow through the annulus 35. The device 152 can be activated when a particular condition occurs to insulate the well above and below the flow-control device 152. For example, the flow-control device 152 may be activated to block fluid flow communication when drilling fluid circulation is stopped so as to isolate the sections above and below the device 152, thereby maintaining the wellbore below the device 152 at or substantially at the pressure condition prior to the stopping of the fluid circulation.

The flow-control devices 154, 156 can also be configured to selectively control the flow path of the drilling fluid. For example, the flow-control device 154 in the umbilical 110 can be configured to direct some or all of the fluid in the annulus 35 into umbilical 110. Such an operation may be used, for example, to reduce the density of the cuttings-laden fluid flowing in the umbilical 110. The flow-control device 156 may include check-valves, packers and any other suitable device. Such devices may automatically activate upon the occurrence of a particular event or condition.

The system 100 also includes downhole devices for processing the cuttings (e.g., reduction of cutting size) and other debris flowing in the umbilical 110. For example, a comminution device 160 can be disposed in the umbilical 110 upstream of the fluid circulation device 150 to reduce the size of entrained cutting and other debris. The comminution device 160 can use known members such as blades, teeth, or rollers to crush, pulverize or otherwise disintegrate cuttings and debris entrained in the fluid flowing in the umbilical 110. The comminution device 160 can be operated by an electric motor, a hydraulic motor, by rotation of drill string or other suitable means. The comminution device 160 can also be integrated into the fluid circulation device 150. For instance, if a multi-stage turbine is used as the fluid circulation device 150, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In one embodiment, the devices 20 and sensors $S_{1-n}$ communicate with a controller 170 via a telemetry system (not shown). Using data provided by the sensors $S_{1-n}$, the controller 170 can, for example, maintain the wellbore pressure at zone 140 at a selected pressure or range of pressures and/or optimize the flow rate of drilling fluid. The controller 170 maintains the selected pressure or flow rate by controlling the fluid circulation device 150 (e.g., adjusting amount of energy added to the return line 126) and/or other downhole devices (e.g., adjusting flow rate through a restriction such as a valve).

When configured for drilling operations, the sensors S11 provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One exemplary type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the fluid circulation device 150 (S2), at the wellhead equipment 104 (S3), in the supply fluid (S4), along the umbilical 110 (S5), at the well tool 108 (S6), in the return fluid upstream of the fluid circulation device 150 (S7), and in the return fluid downstream of the fluid circulation device 150 (S8). It should be understood that other locations may also be used for the sensors $S_{1-n}$.

The controller 170 for suitable for drilling operations can include programs for maintaining the wellbore pressure at zone 140 at under-balance condition, at-balance condition or at over-balanced condition. The controller 170 includes one or more processors that process signals from the various sensors in the drilling assembly and also controls their operation. The data provided by these sensors $S_{1-n}$ and control signals transmitted by the controller 170 to control downhole devices such as devices 150-158 are communicated by a suitable two-way telemetry system (not shown). A separate processor may be used for each sensor or device. Each sensor may also have additional circuitry for its unique operations. The controller 170, which may be either downhole or at the surface, is used herein in the generic sense for simplicity and ease of understanding and not as a limitation because the use and operation of such controllers is known in the art. The controller 170 can contain one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 150-158 and the surface equipment via the two-way telemetry. In other embodiments, the controller 170 can be a hydro-mechanical device that incorporates known mechanisms (valves, biased members, linkages cooperating to actuate tools under, for example, preset conditions).

For convenience, a single controller 170 is shown. It should be understood, however, that a plurality of controllers 170 can also be used. For example, a downhole controller can be used to collect, process and transmit data to a surface controller, which further processes the data and transmits appropriate control signals downhole. Other variations for dividing data processing tasks and generating control signals can also be used. In general, however, during operation, the controller 170 receives the information regarding a parameter of interest and adjusts one or more downhole devices and/or fluid circulation device 150 to provide the desired pressure or range or pressure in the vicinity of the zone of interest 140. For example, the controller 170 can receive pressure information from one or more of the sensors ($S_1$-$S_n$) in the system 100.

As described above, the system 100 in one embodiment includes a controller 170 that includes a memory and peripherals 184 for controlling the operation of the fluid circulation device 150, the devices 154-158, and/or the bottomhole assembly 108. In FIG. 1A, the controller 170 is shown placed at the surface. It, however, may be located adjacent the fluid circulation device 150, in the BHA 108 or at any other suitable location. The controller 170 controls the fluid circulation device to create a desired amount of $\Delta P$ across the device, which alters the bottomhole pressure accordingly. Alternatively, the controller 170 may be programmed to activate the flow-control devices 154-158 (or other downhole devices) according to programmed instructions or upon the occurrence of a particular condition. Thus, the controller 170 can control the fluid circulation device in response to sensor data regarding a parameter of interest, according to programmed instructions provided to said fluid circulation device, or in response to instructions provided to said fluid circulation device from a remote location. The controller 170 can, thus, operate autonomously or interactively.

During drilling, the controller 170 controls the operation of the fluid circulation device to create a certain pressure differential across the device so as to alter the pressure on the formation or the bottomhole pressure. The controller 170 may be programmed to maintain the wellbore pressure at a value or range of values that provide an under-balance condition, an at-balance condition or an over-balanced condition. In one embodiment, the differential pressure may be altered by altering the speed of the fluid circulation device. For instance, the bottomhole pressure may be maintained at a preselected value or within a selected range relative to a parameter of interest such as the formation pressure. The controller 170 may receive signals from one or more sensors in the system 100 and in response thereto control the operation of the fluid circulation device to create the desired pressure differential. The controller 170 may contain pre-programmed instructions and autonomously control the fluid circulation device or respond to signals received from another device that may be remotely located from the fluid circulation device.

In certain embodiments, a secondary fluid circulation device 180 fluidly coupled to the return line 126 cooperates with the fluid circulation device 150 to circulate fluid through the fluid circulation system 120. In one arrangement, the secondary fluid circulation device 180 is positioned uphole or downstream of the fluid circulation device 150. Certain advantages can be obtained by dividing the work associated with circulating drilling fluid between two or more downhole fluid circulation devices. One advantage is that the power requirement (e.g., horsepower rating) for the fluid circulation device 150, which is disposed further downhole that the secondary fluid circulation device 180, can be reduced. A related advantage is that two separate power supplies can be used to energize each of the devices 150, 180. For instance, a surface supplied energy stream (e.g., hydraulic fluid or electricity) can be used to energize the secondary fluid circulation device 180 and a local (wellbore) power supply (e.g., fuel cell) can be used to energize the fluid circulation device 150. Additionally, different types of devices can be used for each of the devices 150, 180. For instance, a centrifugal-type pump may be used for the fluid circulation device 150 and a positive displacement type pump may be used for the secondary fluid circulation device 180. It should also be appreciated that the devices 150, 180 (with the associated flow control devices) can be operated to control fluid flow and pressure (or other parameter of interest) in specified or pre-determined zones along the wellbore 32, thereby providing enhanced control or management of the pressure gradient curve associated with the wellbore 32.

In certain embodiments, a near bit fluid circulation device 182 in fluid communication with the bit 112 provides a local fluid velocity or flow rate that assists in drawing drilling fluid and cuttings through the bit 112 and up towards the fluid circulation device 150. In certain instances, the flow rate needed to efficiently clean the well bottom of cuttings and drilling fluid is higher than that needed to circulate drilling fluid in the wellbore. In one arrangement, the near bit fluid circulation device 182 is positioned sufficiently proximate to the bit 112 to provide a localized flow rate functionally effective for drawing cuttings and drilling fluid away from the bit 112 and into the return line 126. As is known, efficient bit cleaning leads to high rates of penetration, improved bit wear, and other desirable benefits that result in lower overall drilling costs. In one conventional arrangement, the surface pumps are configured to provide this higher pressure differential, which exposes the open hole portions of the wellbore 32 to potentially damaging higher drilling fluid pressures. In another conventional arrangement, the surface pumps are run to provide only the pressure needed to circulate drilling fluid at the cost of, for example, reduced rates of penetration. As can be appreciated, the near bit fluid circulation device 182 can be configured to provide a flow rate that efficiently cleans the bit 112 of cuttings while the fluid circulation device 150 provides the primary motive force for circulating drilling fluid in the fluid circulation system 120. The near bit fluid circulation device 182 can be operated in conjunction with or independently of the fluid circulation devices 150, 180. For instance, the near bit fluid circulation device 182 can have a dedicated power source or use the power source of the fluid circulation device 150. Additionally, as noted earlier, different types of devices can be used for each of the devices 150, 180, 182. It should therefore be appreciated that the near bit fluid circulation device 182 can be configured to provide a localized flow rate to optimize bit cleaning whereas the other fluid circulation devices 150,180 can be configured to optimize the lifting of the return fluid to the surface.

Figure 4:
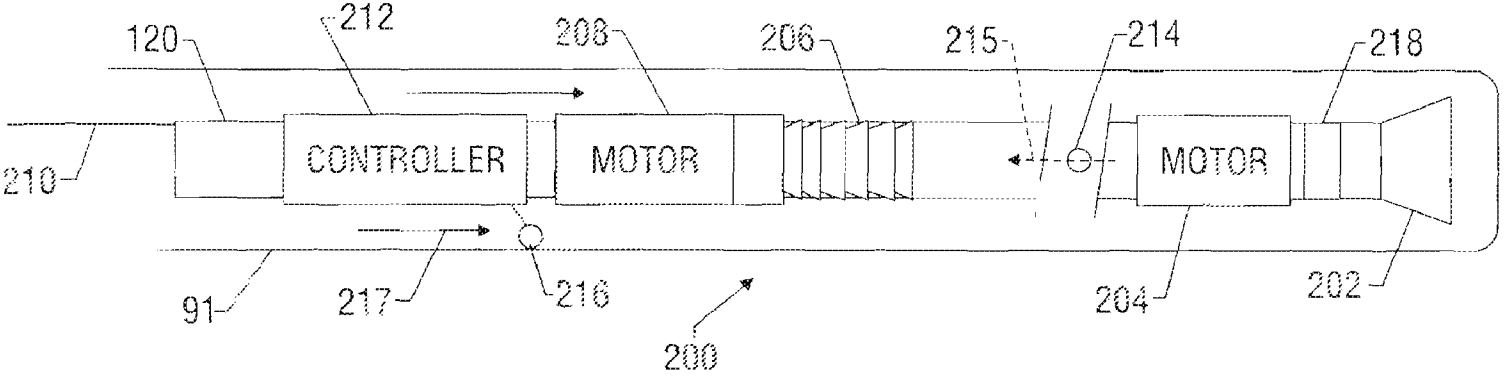
FIG. 4 is a schematic illustration of one embodiment of an arrangement according to the present disclosure wherein a wellbore system uses a fluid circulation device energized by a surface source.

Referring now to FIG. 4, there is schematically illustrated one exemplary well bore assembly 200 utilizing a bit 202 rotated by a downhole motor 204 and a fluid circulation device 206 driven by an associated motor 208. A power transmission line or conduit 210 supplies power to the motors 204, 208. Additionally, the wellbore assembly 200 includes a controller 212, a sensor 214 to measure one or more parameters of interest (e.g., pressure) of the return fluid 215 in the return line 126 (umbilical 110), and a sensor 216 to measure one or more parameters of interest (e.g., pressure) of the supply fluid 217 in the supply line 124 (annulus 91). In one arrangement, the motors 204, 208 are variable speed electric motors that are adapted for use in a wellbore environment. It should be appreciated that an electrical drive provides a relatively simple method for controlling the fluid circulation device. For instance, varying the speed of the electrical motor will directly control the speed of the rotor in the fluid circulation device, and thus the pressure differential across the fluid circulation device. For such motors, the power transmission line 210 can include embedded metal conductors provided in the umbilical 110 to convey electrical power from a surface location (not shown) to the motors 204, 208 and other equipment (e.g., the controller 212). Because electric motors are usually more efficient at higher speeds, a suitable fluid circulation device 206 can include a centrifugal type pump or turbine that likewise operate more efficiently at higher speeds. Other embodiments of motors can be operated by pressurized gas, hydraulic fluid, and other energy streams supplied from a surface location, such energy streams being readily apparent to one of ordinary skill in the art. Where appropriate, a positive displacement pump may be used in the fluid circulation device 206. In one mode of operation, the controller 212 receives signal input from the sensors 214,216, as well as other sensors S1-S8 (FIG. 3). The power transmission line 210 can be configured to carry communication signals for enabling two-way telemetric communication between a controller 242 and the surface as well as other downhole equipment. Based on the received sensor data, the controller 212 controls the motors 204, 208 to obtain a bit rotation speed and/or pump flow rate/pressure differential that optimizes one or more selected drilling parameters (e.g., rate of penetration). Other modes of operation have been previously discussed and will not be repeated.

It should be appreciated that FIG. 4 illustrated merely one exemplary well bore assembly. Other equally suitable arrangements can include a single motor (electric or otherwise) that drives both the bit and the fluid circulation device. If the bit and pump are to rotate at different speeds, then a suitable speed/torque conversion unit (not shown) can used to provide a fixed or adjustable speed/torque differential. Alternatively, multiple motors may be used to drive the fluid circulation device and/or the drill bit. By speed/torque conversion unit it is meant known devices such as variable or fixed ratio mechanical gearboxes, hydrostatic torque converters, and a hydrodynamic converters. The controller 212 can optionally be programmed to operate such a speed/torque conversion unit. Still other embodiments can include one or more devices that provide mechanical weight on bit; e.g., thrusters and anchor assemblies. As is known, thrusters can provide an axial thrusting force that urges a drill bit into a formation and thereby enhances bit penetration. Anchors typically engage a wellbore wall with retractable members such as pads to absorb the reaction force produced by the thruster. Thrusters and associated anchors are known in the art and will not be discussed in further detail. Moreover, if the umbilical 110 is drill string, then surface rotation of the drill string 110 can be used to either exclusively or cooperatively rotate the bit 202. Still further, in yet another embodiment not shown, a cross-flow sub proximate to the drill bit is used to channel fluid from the annulus into the umbilical. Thus, in a conventional manner, the drilling fluid exits the nozzles of the drill bit and enters the annulus with the entrained cuttings. Thereafter, the fluid and entrained cuttings are channeled into the umbilical by the cross-flow sub.

Figure 5:
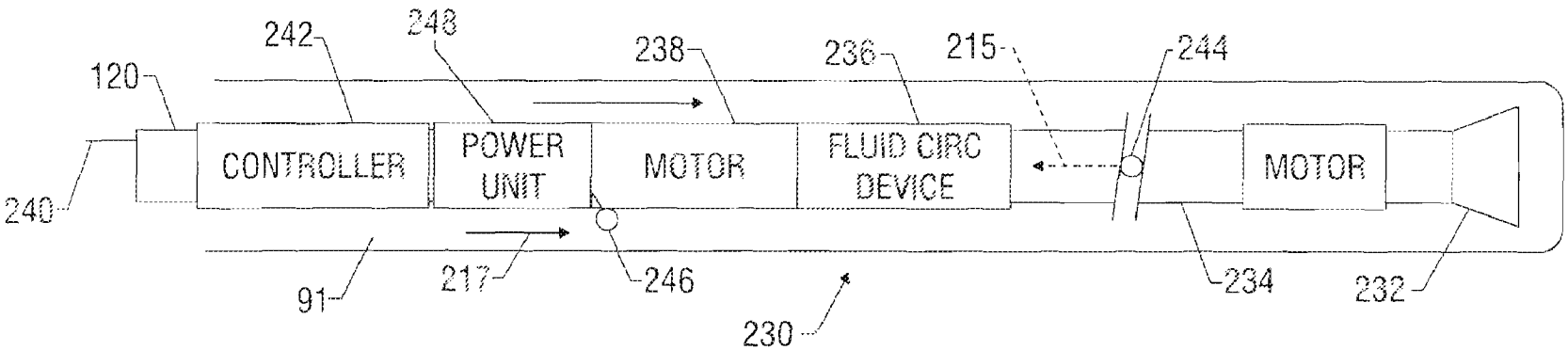
FIG. 5 is a schematic illustration of one embodiment of an arrangement according to the present disclosure wherein a wellbore system uses a fluid circulation device energized by a local (wellbore) source.

Referring now to FIG. 5, there is schematically illustrated another exemplary well bore assembly 230 utilizing a bit 232 rotated by a downhole motor 234 and a fluid circulation device 236 driven by an associated motor 238. A signal transmission line 240 enables two-way telemetric communication between a controller 242 and the surface and can optionally be configured to transfer power in a manner described below. The wellbore assembly 230 also includes a sensor 244 to measure one or more parameters of interest (e.g., pressure) of the return fluid 215 in the return line (umbilical 110) and a sensor 246 to measure one or more parameters of interest (e.g., pressure) of the supply fluid 217 in the supply line 124 (annulus 91). Advantageously, the wellbore system 230 includes a downhole power unit 248 for energizing the motors 238, 234. In one arrangement wherein the motors 238, 234 are electric, the power unit 248 supplies electrical power by converting a stored energy supply (e.g., a combustible fluid, hydrogen, methanol, or charges of compressed fluids) into electricity. For example, the power unit 248 can include a fuel cell or an internal combustion engine-generator set. The stored energy supply, in certain embodiments, is replenished from a surface source (not shown) via the line 240. The power supply can also include a geothermal energy conversion unit or other known systems for generating the power used to energize the motors 238,234. In other arrangements wherein the motor 238, 234 are hydraulic, a suitable hydraulic fluid can be stored in the power unit 248. Moreover, an intermediate device, such as an electrically-driven pump, can be used to pressurize and circulate this hydraulic fluid.

It should be understood that the FIGS. 4 and 5 arrangements can readily be modified to include any or all of the earlier described features; e.g., a plurality of fluid circulation devices positioned serially or in parallel along the return line.

It will be appreciated that many variations to the above-described embodiments are possible. For example, bypass devices, cross-flow subs and conduits (not shown) can be provided to selectively channel fluid around the fluid circulation device. The fluid circulation device is not limited to merely positive displacement pumps and centrifugal type pump. For example, a jet pump can be used. In an exemplary arrangement, a portion of the supply fluid is accelerated by a nozzle and discharged with high velocity into the return line, thereby effecting a reduction in annular pressure. Pumps incorporating one or more pistons, such as hammer pumps, may also be suitable for certain applications. Additionally, a clutch element can be added to the shaft assembly connecting the drive to the pump to selectively couple and uncouple the drive and pump of a fluid circulation device. Further, in certain applications, it may be advantages to utilize a non-mechanical connection between the drive and the pump. For instance, a magnetic clutch can be used to engage the drive and the pump. In such an arrangement, the supply fluid and drive and the return fluid and pump can remain separated. The speed/torque can be transferred by a magnetic connection that couples the drive and pump elements, which are separated by a tubular element (e.g., drill string).

In other aspects, the present disclosure includes systems, devices and methods for controlling an annular pressure at one or more selected depths along a wellbore and optimizing the pressure gradients associated with reverse circulation for specific drilling or formation conditions.

One application for pressure optimization and control includes varying the pressure in a wellbore annulus to compensate for circulating pressure losses associated with reverse circulation. The inventors have perceived that pressure in a wellbore annulus having a mud column can drop below the hydrostatic pressure of the mud column during reverse circulation. Moreover, the inventors have perceived that such a pressure loss can impact drilling activity and particularly drilling activity involving extended reach wells or wells having particular wellbore geometries.

Figure 6A:
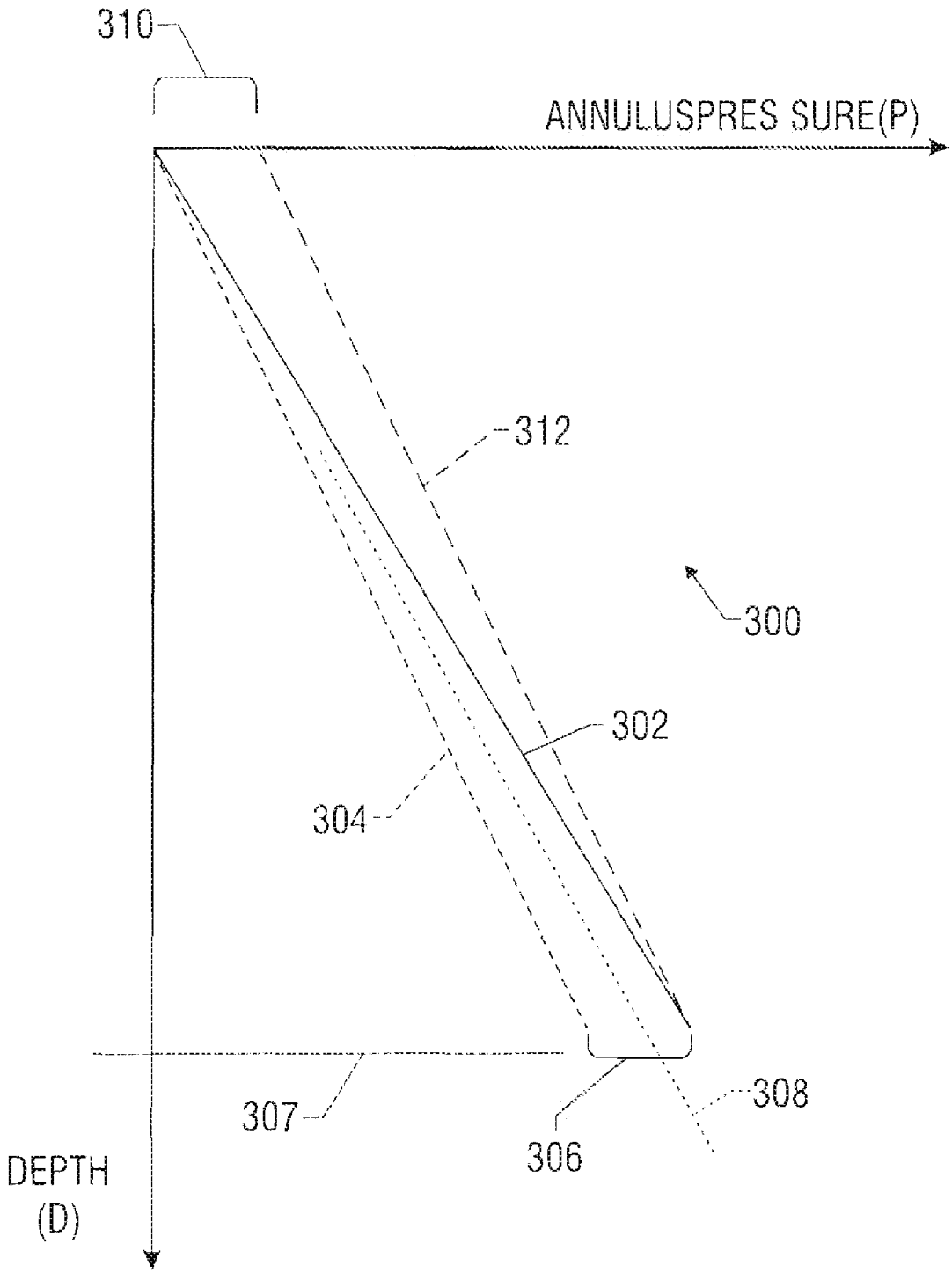
FIG. 6A graphically illustrates a circulating pressure loss associated with reverse circulation drilling.

Referring now to FIG. 6A, there is shown an illustrative graph 300 having annulus pressure P along the abscissa and depth D along the ordinate. The graph 300 can be generally reflective of the systems shown in FIGS. 2 and 3. A line 302 represents the pressure gradient in a supply line (e.g., supply line 22 of FIG. 2) when drilling fluid is in the annulus but is not being circulated. Thus, line 302 generally indicates a hydrostatic pressure in the supply line. Operation of the fluid circulation devices such as device 30 of FIG. 2 or device 150 of FIG. 3 initiates fluid circulation, which creates a pressure drop in the annulus that shifts the pressure gradient to that shown by line 304. Numeral 306 identifies an illustrative pressure loss at a depth 307 along the wellbore. That is, at depth 307, annulus pressure has dropped by an amount shown by numeral 306. In some situations, this pressure loss can be problematic. For example, line 308 represents a pore pressure of the formation. Generally, the mud weight of the drilling fluid is selected to provide a hydrostatic pressure that is greater than the pore pressure to reduce the risk of a well kick. As can be seen, the pressure loss 306 can lower annulus pressure below that of pore pressure, which could lead to an unstable well condition. The teachings of the present disclosure include devices and methods for compensating for such pressure losses.

One illustrative method for compensating for pressure losses during reverse circulation includes selecting a mud weight for the drilling fluid that at least partially offsets the pressure loss. For example, a value is determined for one or more formation parameters that serve as a basis for selecting an appropriate mud weight. Exemplary parameters include formation pressure parameters such as pore pressure and fracture pressure or other parameters relating to the wellbore, BHA and/or drill string. Next, a mud weight is selected that provides during reverse circulation a desired pressure at a selected depth and/or a desired pressure gradient with respect to the selected parameter(s). The selection process can utilize measured downhole data, empirical test data and/or predictive analysis. For instance, the pore pressure can be determined and the mud weight selected to provide a wellbore pressure at a selected depth or depths than remains above pore pressure during reverse circulation. The mud weight can be selected to partially offset, fully offset or overcompensate for the circulating pressure loss.

Figure 6B:
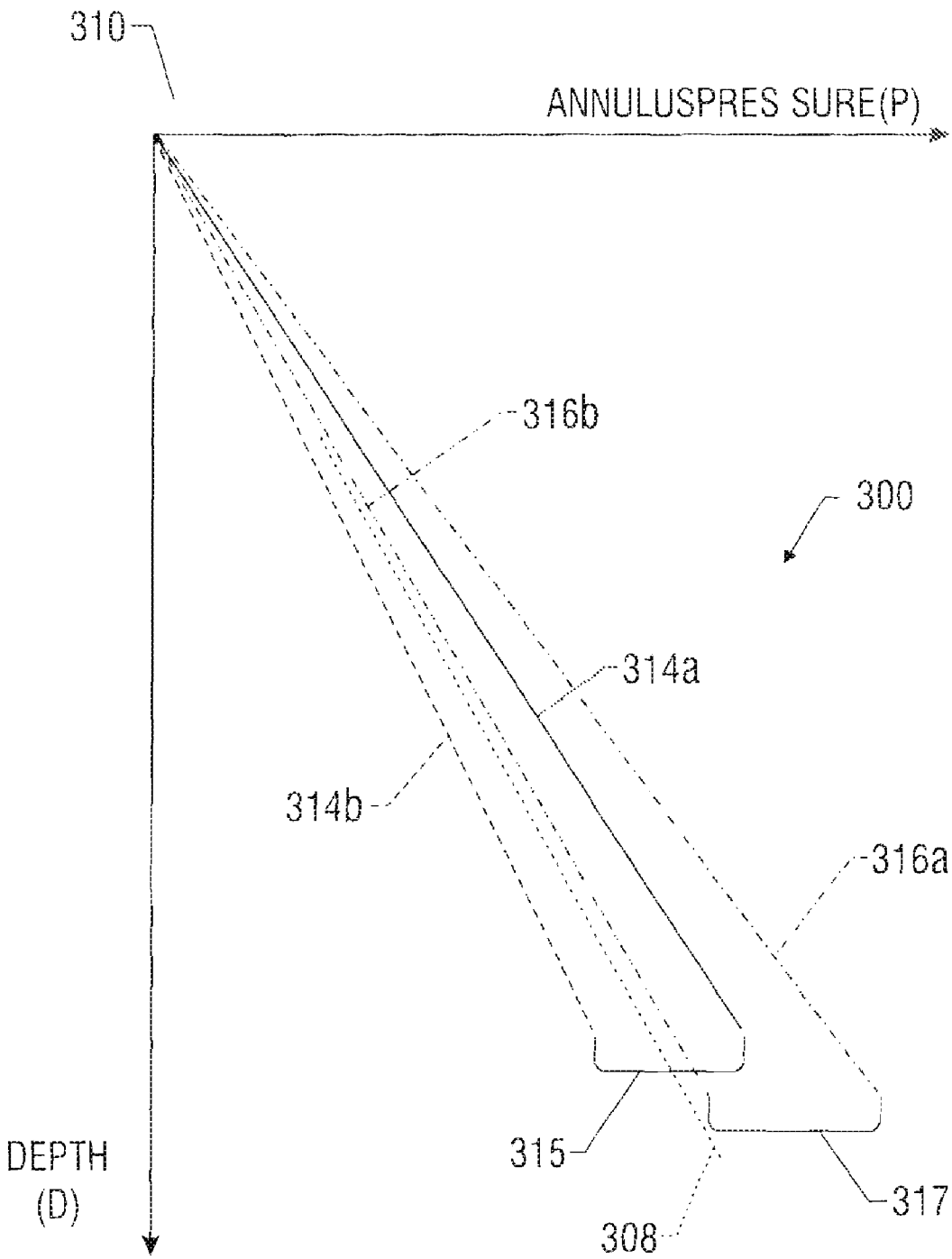
FIG. 6B graphically illustrates the effect of one exemplary methodology using selective mud weights to manage circulating pressure loss associated with reverse circulation drilling.

The operational influence of the above-described methodology of selective manipulation of mud weights is illustrated in FIG. 6B. In FIG. 6B, line 314A represents the pressure gradient in the annulus under a static condition, i.e., no fluid circulation, and 314B represents the pressure gradient in the annulus during fluid circulation. The pore pressure gradient is shown with line 308. The mud weight for the drilling fluid circulated under this scenario causes a wellbore pressure above pore pressure during static conditions but a circulating pressure loss 315 during circulation causes the wellbore pressure to drop below the pore pressure. In accordance with one embodiment of the present disclosure, the weight of the drilling fluid is selected to provide a wellbore pressure approximately at or greater than pore pressure even after circulating pressure losses are considered. For example, the mud weight for the drilling fluid can be selected to cause a wellbore pressure above pore pressure during circulation. Such a scenario is illustrated by lines 316A,B. 316A represents the pressure gradient in the annulus under a static condition, i.e., no fluid circulation, and 316B represents the pressure gradient in the annulus during fluid circulation. Thus, even when a circulating pressure loss 317 shifts the pressure gradient to the left, i.e., reduces pressure, the wellbore pressure is maintained above the pore pressure gradient 308. As noted earlier, while pore pressure has been used as the reference formation parameter for selecting a mud weight, other formation parameter or even drilling parameters can also be considered in selected a particular mud weight for a drilling fluid circulated in the wellbore.

Figure 7:
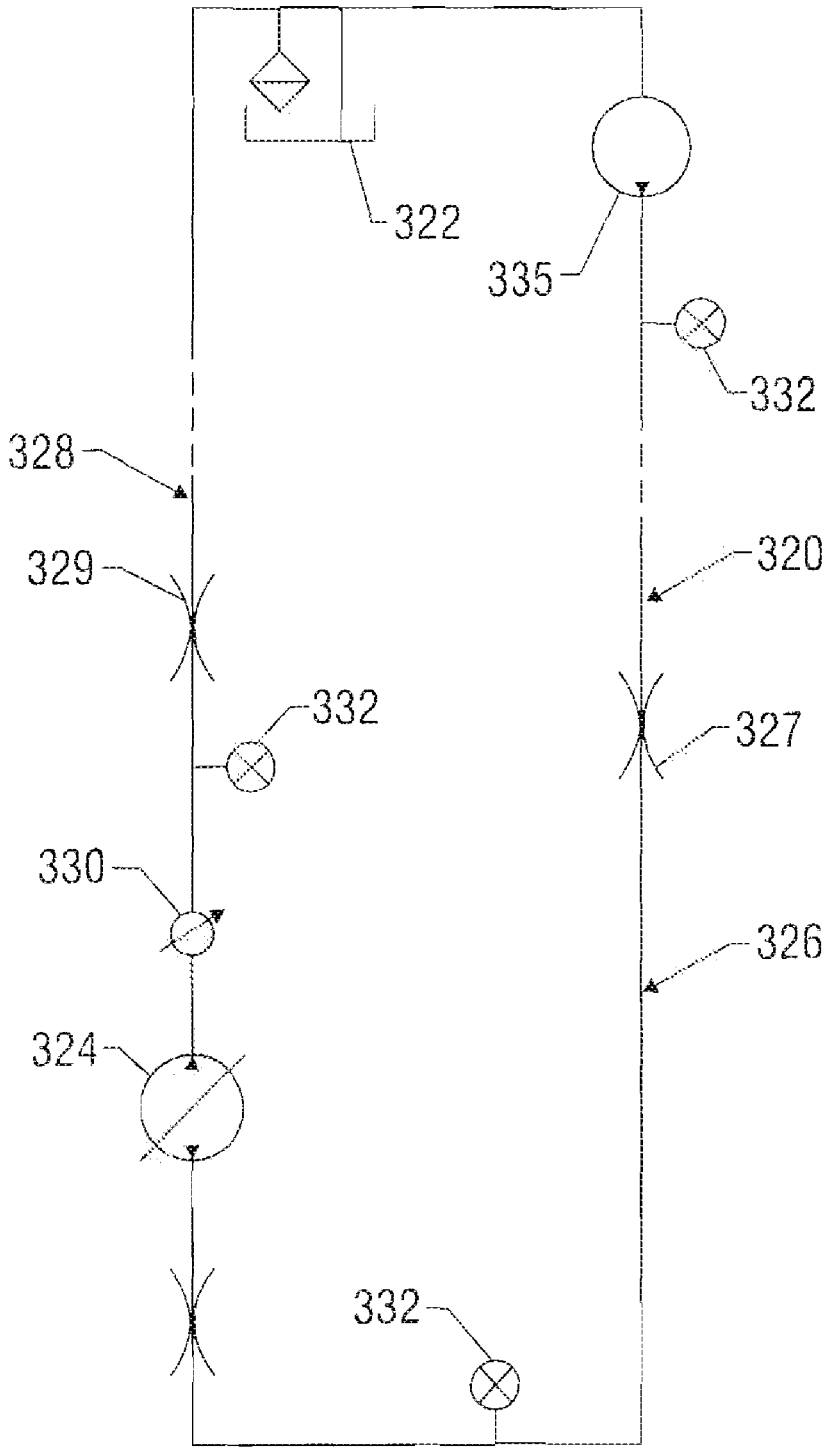
FIG. 7 is a schematic illustration of one embodiment of an arrangement according to the present disclosure for compensating for circulating losses associated with reverse circulation.

Referring now to FIG. 7, there is schematically shown one embodiment of a reverse circulation system 320 that compensates for circulating pressure loss. The system 320 includes a surface drilling fluid supply 322 and a downhole fluid circulation device 324. The fluid circulation device 324 can be of any type previously described and in some embodiments has bi-directional flow; i.e., pump fluid uphole and downhole. Drilling fluid flows into the wellbore via a supply line 326 and is pumped to the surface by the fluid circulation device 324 via a return line 328. As described previously, the supply line 326 can be formed at least partially of an annulus 327 and the return line 328 can be formed at least partially of a drilling tubular 329. Additional devices include a return line flow control device 330 and sensors 332 such as pressure sensors. The return line flow control device 330 can be configured to selectively control the direction of flow in the return line 328. This can be advantageous to, for example, prevent back flow downhole through the drilling tubular if circulation is interrupted. Suitable control devices 330 include one-way check valves and other such devices. The devices 330 can be configured to be activated or deactivated as needed to support drilling activity. In other embodiments, the fluid circulation device 324 can function to control flow direction. For example, the fluid circulation device 324 can include a progressive cavity pump and brake arrangement that prevents undesirable backflow through the fluid circulation device 324. The fluid circulation device 324 can have bi-directional flow; i.e., pump fluid uphole and downhole. Sensors can be positioned through the system 320 to monitor parameters of interest such as annulus pressure, pipe bore pressure, and wellhead pressure. These sensors can assist in determining whether an out of norm condition such as a plugged annulus exists in the wellbore, in estimating cuttings load and concentration in the return line 328, and maintaining overall control of the drilling activity.

To compensate for circulating pressure loss, an active pressure differential (APD) device 335 coupled to the supply line 326 increases the pressure in the supply line 326. The active pressure differential device is a device that is capable of creating a pressure differential "ΔP" across the device. For example, the APD Device 335 is operated to apply a pressure differential to the fluid in the supply line 326 in an amount that at least partially offsets the circulating pressure loss. Exemplary APD devices include centrifugal pumps, positive displacement pump, jet pumps and other like devices. Suitable APD devices can be uni-directional or selectively bi-directional (i.e., operate to pump fluid both uphole and downhole).

The operational influence of the APD Device 335 is illustrated in FIG. 6A. In FIG. 6A, the line 304 represents the pressure gradient in the annulus when drilling fluid is circulated without the APD Device 335 in operation. Operation of the APD device 335 applies a pressure increase, shown by numeral 310, to the fluid in the supply line 326. The result of the pressure increase 310 is an adjusted pressure gradient shown by numeral 312. The adjusted pressure gradient 312 can be varied as desired by changing the amount of the pressure increase 310 applied to the supply line fluid. Thus, the adjusted pressure gradient curve 312 and the resulting annulus pressure values at selected depths (e.g., depth 307) can be controlled during reverse circulation. As in the method involving varying mud weight, the pressure increase 310 can be varied with respect to one or more parameters of interest such as a formation parameter, a BHA operating parameter, a drilling parameter, etc. A surface and/or downhole controller (see, e.g., FIGS. 2 and 3) can cooperatively or separately control the fluid circulation device 344 and/or the APD Device 335 to vary the pressure in the annulus.

In one exemplary method of operating the FIG. 7 system, a mud weight for the drilling fluid is selected to provide a hydrostatic pressure approximately at or above the pore pressure of a subterranean formation. Once energized, the fluid circulation device 324 pumps fluid from the wellbore to the surface via the return line 326, which then causes drilling fluid to flow down the supply line 326 (e.g., the well annulus). The circulating pressure loss associated with the now established reverse circulation is at least partially offset by the pressure increase provided by the APD Device 335. Thus, for example, the wellbore pressure in the annulus can be maintained at or above the formation pore pressure.

Controlling annulus wellbore pressure can also be desirable in offshore applications wherein fluid is circulated from an offshore platform into a subsea wellbore bore. In aspects, the teachings of the present disclosure relate to controlling annular pressure in offshore applications.

Figure 8A:
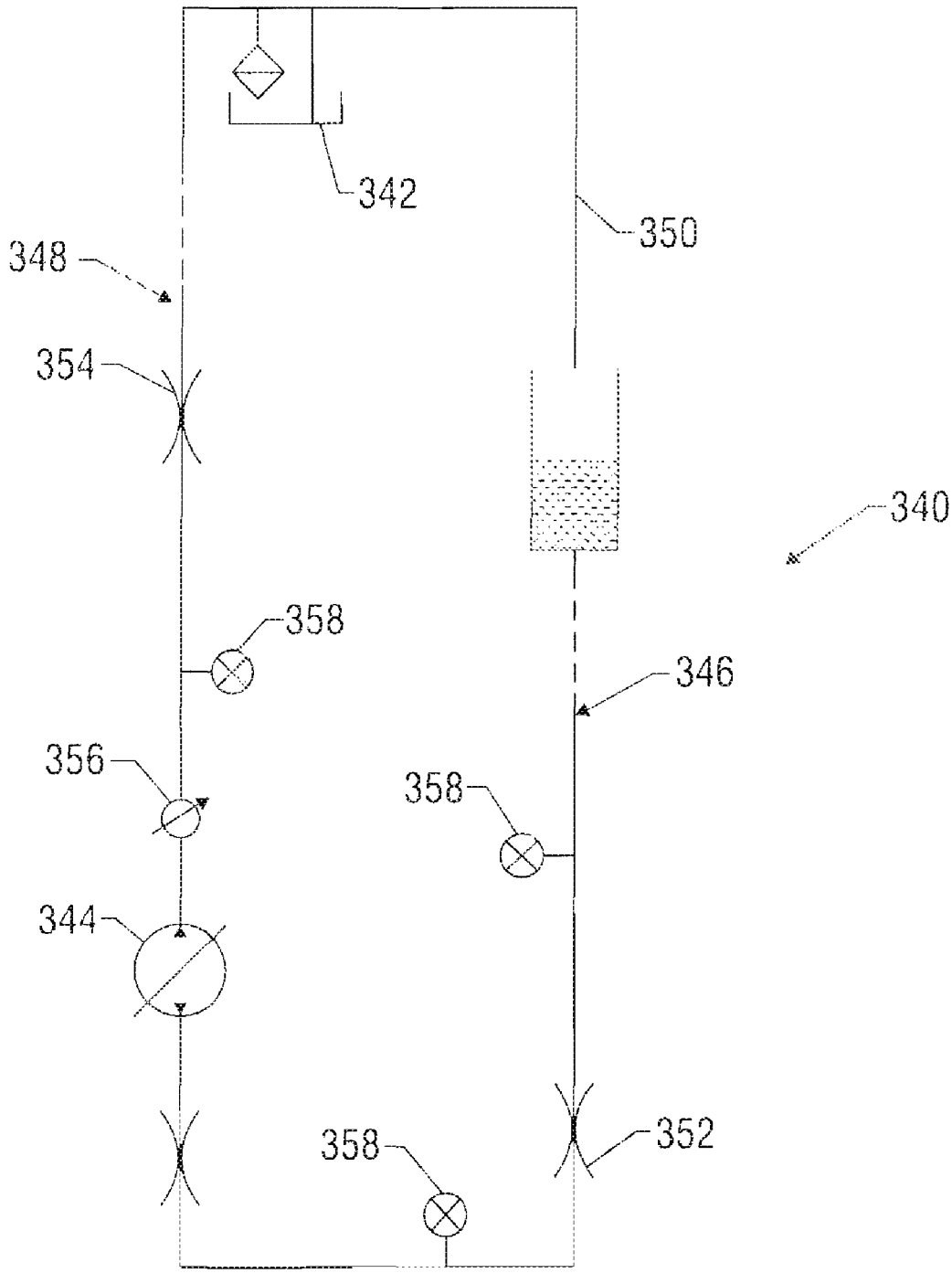
FIG. 8A is a schematic illustration of one embodiment of an arrangement according to the present disclosure for reverse circulation in offshore applications.

Referring now to FIG. 8A, there is schematically shown one embodiment of a reverse circulation system 340 adapted for offshore drilling operations. The system 340 includes a surface drilling fluid supply 342 situated on an offshore platform or vessel (not shown) and a downhole fluid circulation device 344. The fluid circulation device 344 can be of any type previously described and in some embodiments has bi-directional flow; i.e., pump fluid uphole and downhole. Drilling fluid flows into the wellbore via a supply line 346 and returns via a return line 348. The supply line 346 includes a riser portion 350 extending between the offshore platform (not shown) and a subsea well head (not shown) as well as an annulus 352 of the subsea wellbore. The return line 348 can be formed at least partially of a drilling tubular 354. Additional devices include previously discussed devices such as a return line flow control device 356 and sensors 358 such as pressure sensors. In addition to sensor functions previously described, the sensors can be used to determine the amount or volume of drilling fluid in the supply line 346. During operation, the fluid circulation device 344 initiates and controls the flow circulation in the system 340.

Figure 8B:
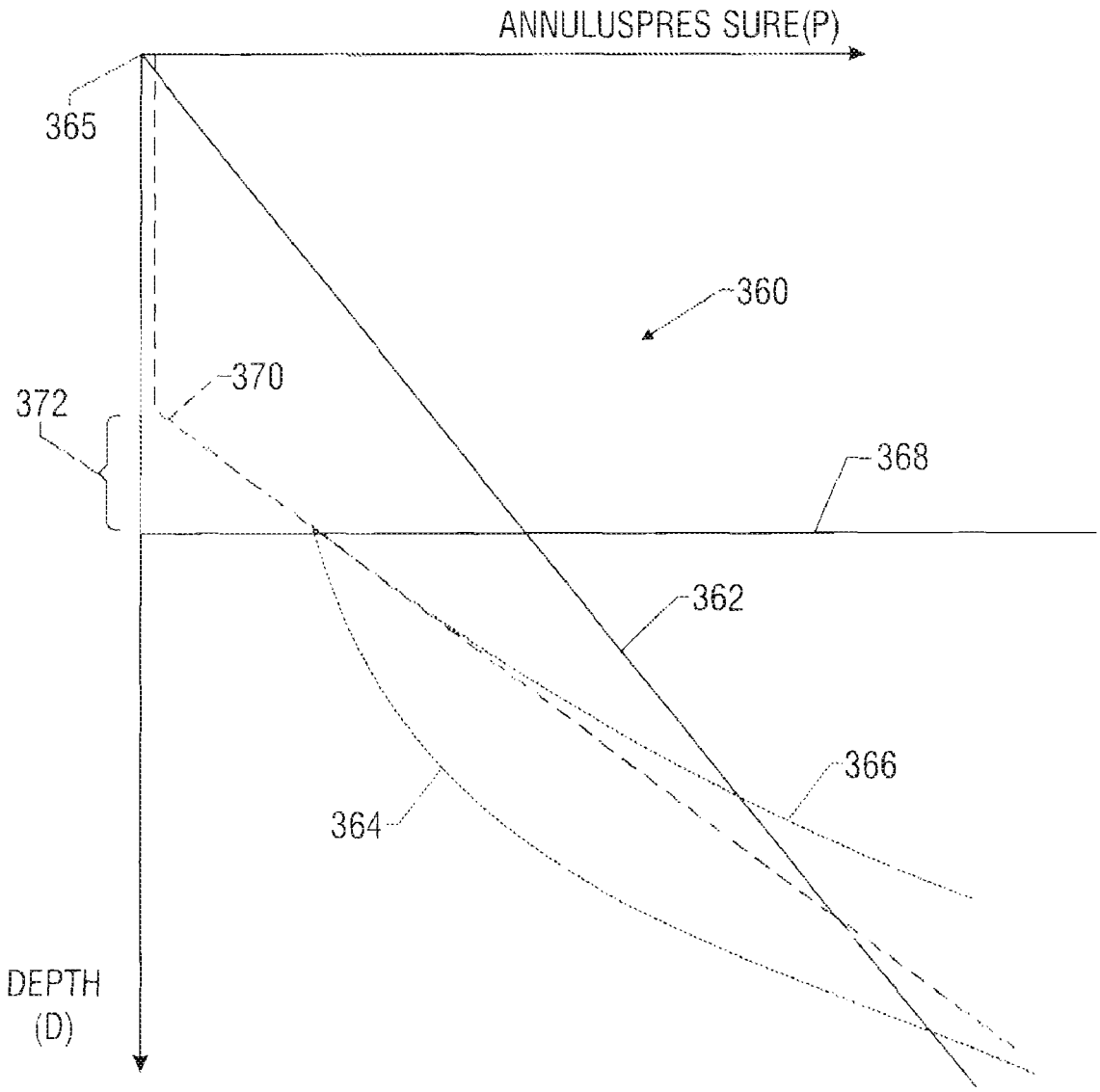
FIG. 8B graphically illustrates the operational influence of the FIG. 8A embodiment on annulus pressure during reverse circulation.

An illustrative pressure gradient for the system 340 is shown in FIG. 8B, which has an illustrative graph 360 having annulus pressure P along the abscissa and depth D along the ordinate. A curve 362 illustrates the pressure gradient along the supply line 346 that would present in a reverse circulation system with a downhole fluid circulation device but without a system providing pressure control. Also shown on graph 360 is an exemplary formation pore pressure curve 364 and an exemplary formation fracture pressure curve 366. Numeral 365 indicates the water surface or a depth of zero. As can be seen, the pressure gradient curve 362 exceeds the formation fracture pressure even at depth 368 of the seafloor, which of course can compromise well integrity.

Referring back to FIG. 8A, to align the pressure gradient curve in the supply line 346 to a pressure gradient that is compatible with the pore and fracture pressures of a formation, the system 340 utilizes a riser 346 that is selectively filled with drilling fluid. As is known, the fluid column in the riser creates a hydrostatic head at the seafloor. The magnitude of the hydrostatic pressure at the seafloor varies directly with the height of the fluid column. In one embodiment of the present disclosure, drilling fluid is supplied into the riser 350 at a rate or in an amount to form a drilling fluid column having a height in the riser that causes a selected annular pressure at or near the seafloor. Sensors 358 can provide information such as annulus pressure measurements and height of drilling fluid in the riser 350 that can be used by the system 340 to maintain pressure in the supply line 346 with selected ranges or values.

The operational influence of a selectively filled riser is illustrated in FIG. 8B. In FIG. 8B, a line 370 shows a pressure gradient curve associated with a drilling fluid column having a height 372 from the depth 368 at the seafloor. As shown, the height 372 of the fluid column in the riser 350 is selected so that the annulus pressure in the wellbore, shown by the pressure gradient curve 370, remains generally within the pore pressure 364 and the fracture pressure 366, although this need not necessarily be the case. The pressure gradient curve 370 can also be adjusted or controlled to provide an at-balanced or an underbalanced condition.

Figure 9A:
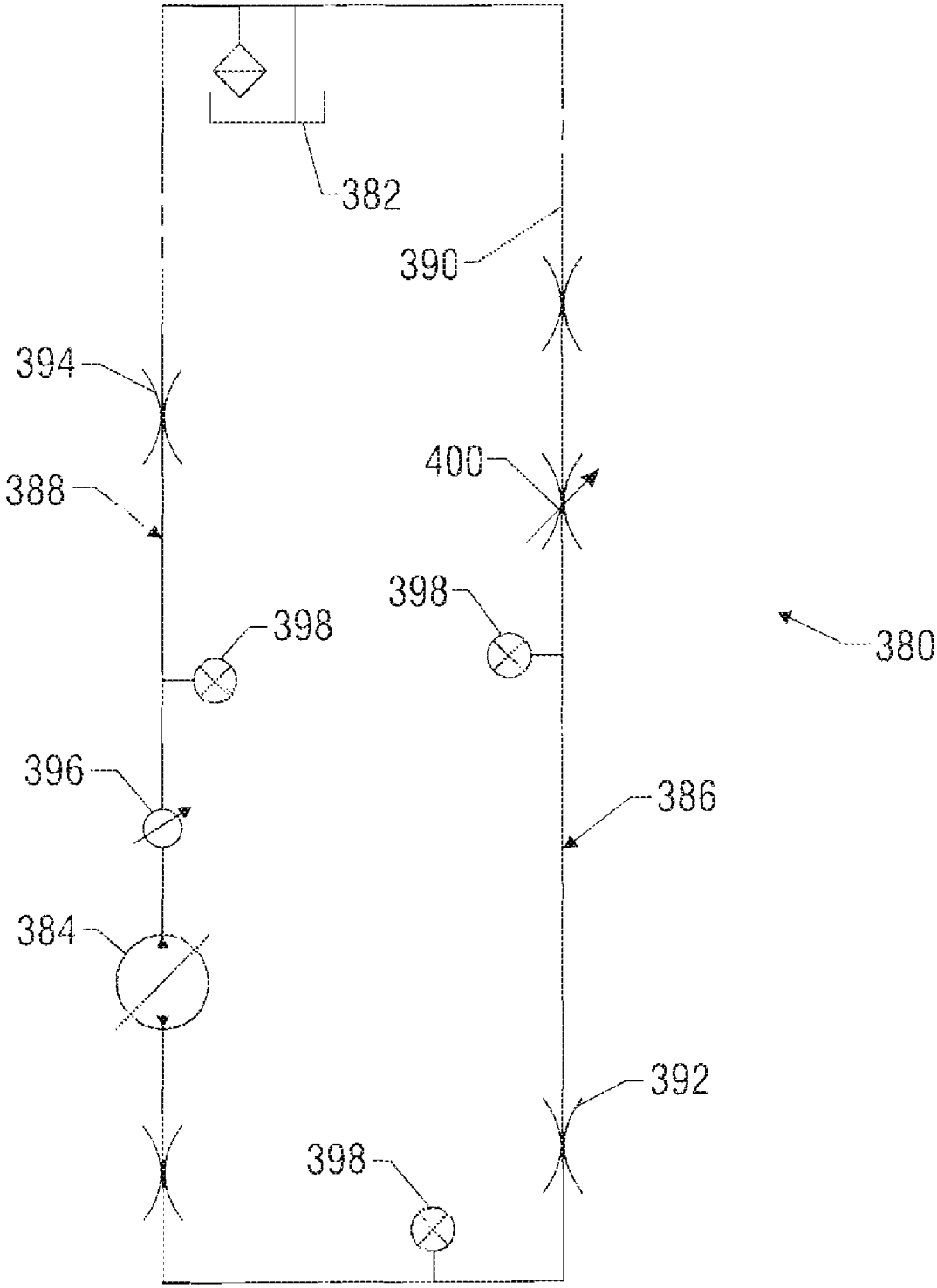
FIG. 9A is a schematic illustration of another embodiment of an arrangement according to the present disclosure for reverse circulation in offshore applications.

Referring now to FIG. 9A, there is schematically shown another embodiment of a reverse circulation system 380 adapted for offshore drilling operations. The system 380 includes a surface drilling fluid supply 382 situated on an offshore platform (not shown) and a downhole fluid circulation device 384. The fluid circulation device 384 can be of any type previously described and in some embodiments has bi-directional flow; i.e., pump fluid uphole and downhole. Drilling fluid flows into the wellbore via a supply line 386 and returns via a return line 388. The supply line 386 includes a riser portion 390 extending between the offshore platform (not shown) and a subsea well head (not shown) as well as an annulus 392 of the subsea wellbore. The return line 388 can be formed at least partially of a drilling tubular 394. Additional devices include previously discussed devices such as a return line flow control device 396 and sensors 398 such as pressure sensors.

To control annulus pressure, a supply line flow control device 400 is positioned along the supply line 386, e.g., in the riser, at the seafloor or in the wellbore. The flow control device 400 selectively restricts the flow through the supply line 386. In one embodiment, the control device 400 selectively restricts the cross-sectional flow area in the supply line 386. Suitable control devices include, but are not limited to, chokes, throttling devices, flow restrictors, and valves. The fluid circulation device 384 is configured as progressive cavity pump or other suitable device that maintains flow rate while the flow control device 400 restricts flow. The combined operation of the fluid circulation device 384 and the flow control device 400 reduces annulus pressure at locations downhole of the flow control device 400. In one mode of operation, the flow control device 400 selectively reduces the cross-sectional flow area in the supply line 386. In response, to maintain the selected fluid flow circulation rate, the pressure differential across the fluid circulation device 384 increases in magnitude. The increased pressure differential across the fluid circulation device 384 is seen as a drop in pressure downhole of the flow control device 400. This pressure differential reduces pressure downhole of the flow control device 400. In this manner, annular wellbore pressure can be adjusted by controlling operation of the control device 400 and/or the fluid circulation device 384.

Figure 9B:
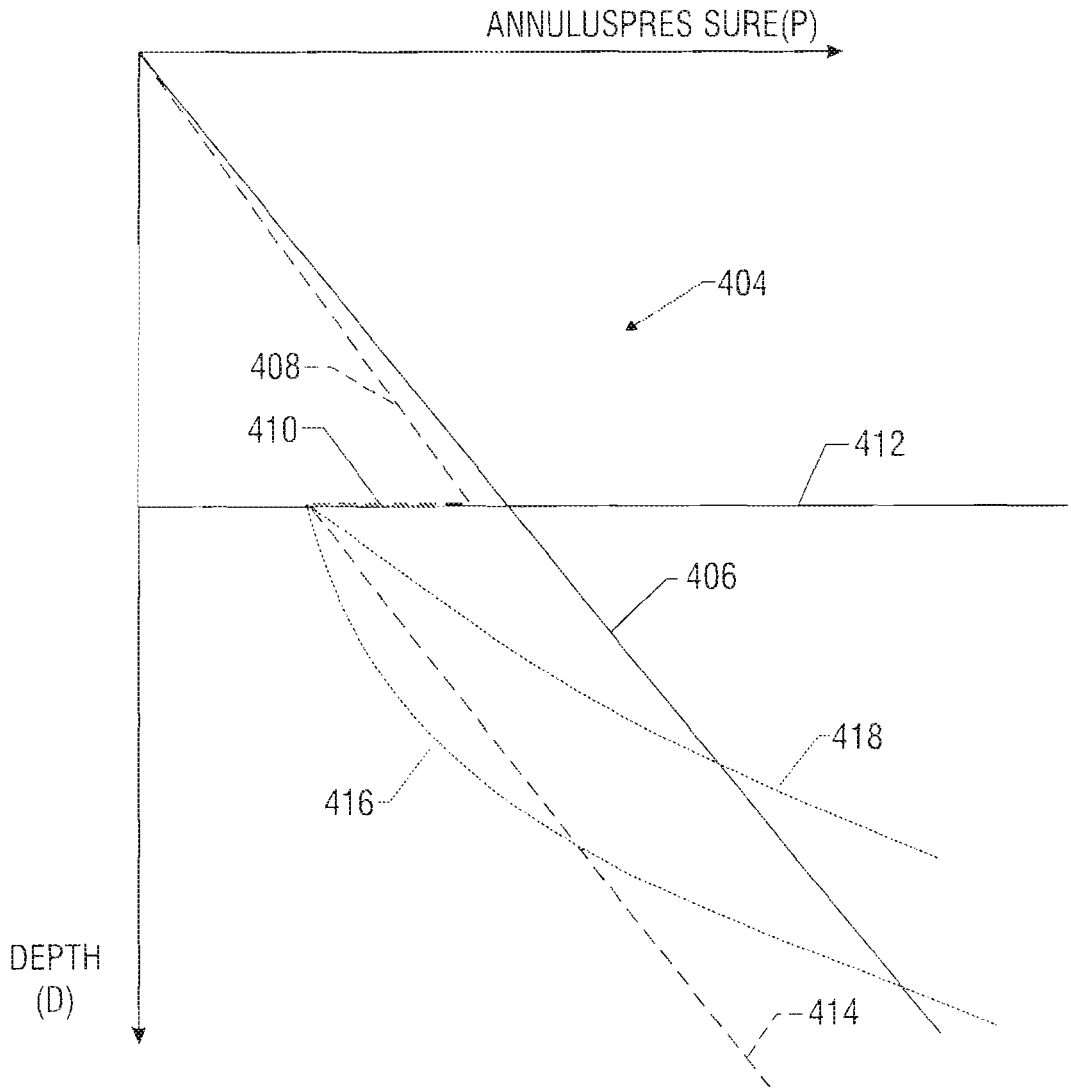
FIG. 9B graphically illustrates the operational influence of the FIG. 9A embodiment on annulus pressure during reverse circulation.

An illustrative pressure gradient for the system 380 is shown in FIG. 9B, which has an illustrative graph 404 having annulus pressure P along the abscissa and depth D along the ordinate. A pressure gradient curve 406 shows the pressure along the supply line 386 if the flow control device 400 is not operational. As can be seen, the pressure gradient curve 406 is generally hydrostatic pressure. If fluid is circulating, then the pressure gradient curve 406 would be shifted to the left due to circulating pressure loss, as shown by line 408. When activated, the flow control device 400 restricts flow that causes a pressure drop shown with numeral 410 in a manner previously described. The pressure drop 410 is shown at a depth 412 generally at the seafloor but could be elsewhere along the supply line 386, including inside the wellbore itself. From the depth 412, the pressure in the supply line 386 is shown by an adjusted pressure gradient curve 414. Also shown on graph 404 is an exemplary formation pore pressure curve 416 and an exemplary formation fracture pressure curve 418. As shown, the pressure drop 410 is selected so that the pressure gradient curve 414 remains generally within the pore pressure 416 and the fracture pressure 418, although this need not necessarily be the case. The pressure gradient curve 406 can also be adjusted or controlled to provide an at-balanced or an underbalanced condition.

Figure 10A:
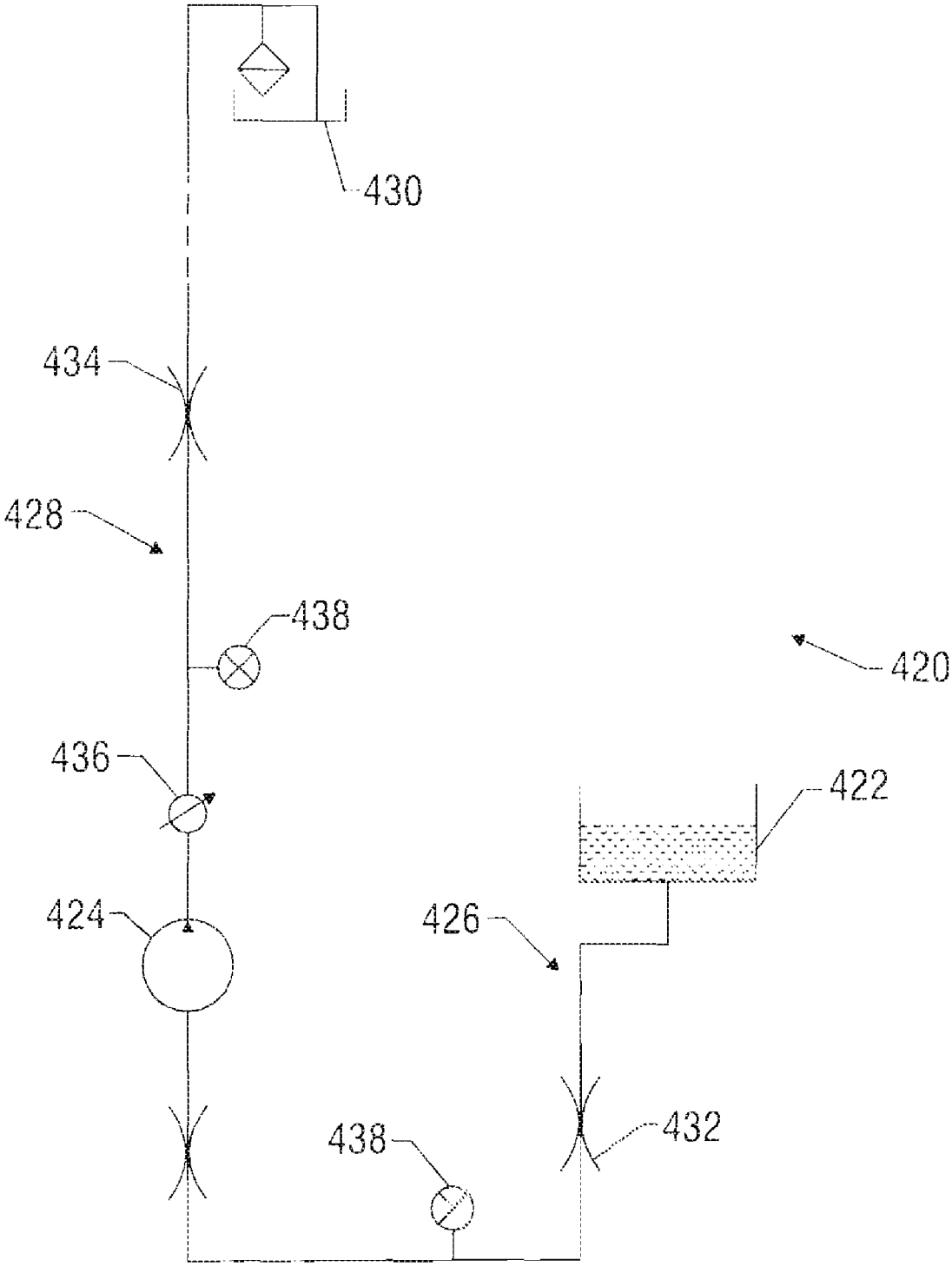
FIG. 10A is a schematic illustration of still another embodiment of an arrangement according to the present disclosure for reverse circulation in offshore applications.

Referring now to FIG. 10A, there is schematically shown still another embodiment of a reverse circulation system 420 adapted for offshore drilling operations. The system 420 includes a drilling fluid supply 422 situated at or near a sea floor (not shown) and a downhole fluid circulation device 424. The fluid circulation device 424 can be of any type previously described and in some embodiments has bi-directional flow; i.e., pump fluid uphole and downhole. Drilling fluid flows into the wellbore via a supply line 426 and returns via a return line 428 to a receptacle 430, which can be located on land, on an offshore platform, drill ship or subsea location. The supply line 426 includes a subsea well head (not shown) as well as an annulus 432 of the subsea wellbore. The return line 428 can be formed at least partially of a drilling tubular 434. Additional devices include previously discussed devices such as a flow control device 436 and sensors 438 such as pressure sensors. As should be appreciated, positioning the drilling fluid supply 422 in a subsea location eliminates the drilling fluid column in a riser and the associated hydrostatic pressure head. In one embodiment, the pressure of the fluid in the drilling fluid supply 422 is equalized with that of the surrounding water. Thus, drilling fluid entering into the subsea wellbore is at a pressure substantially equal to the hydrostatic pressure of the water at the sea floor. This pressure, however, can be increased or decreased as needed for a particular application or situation.

Figure 10B:
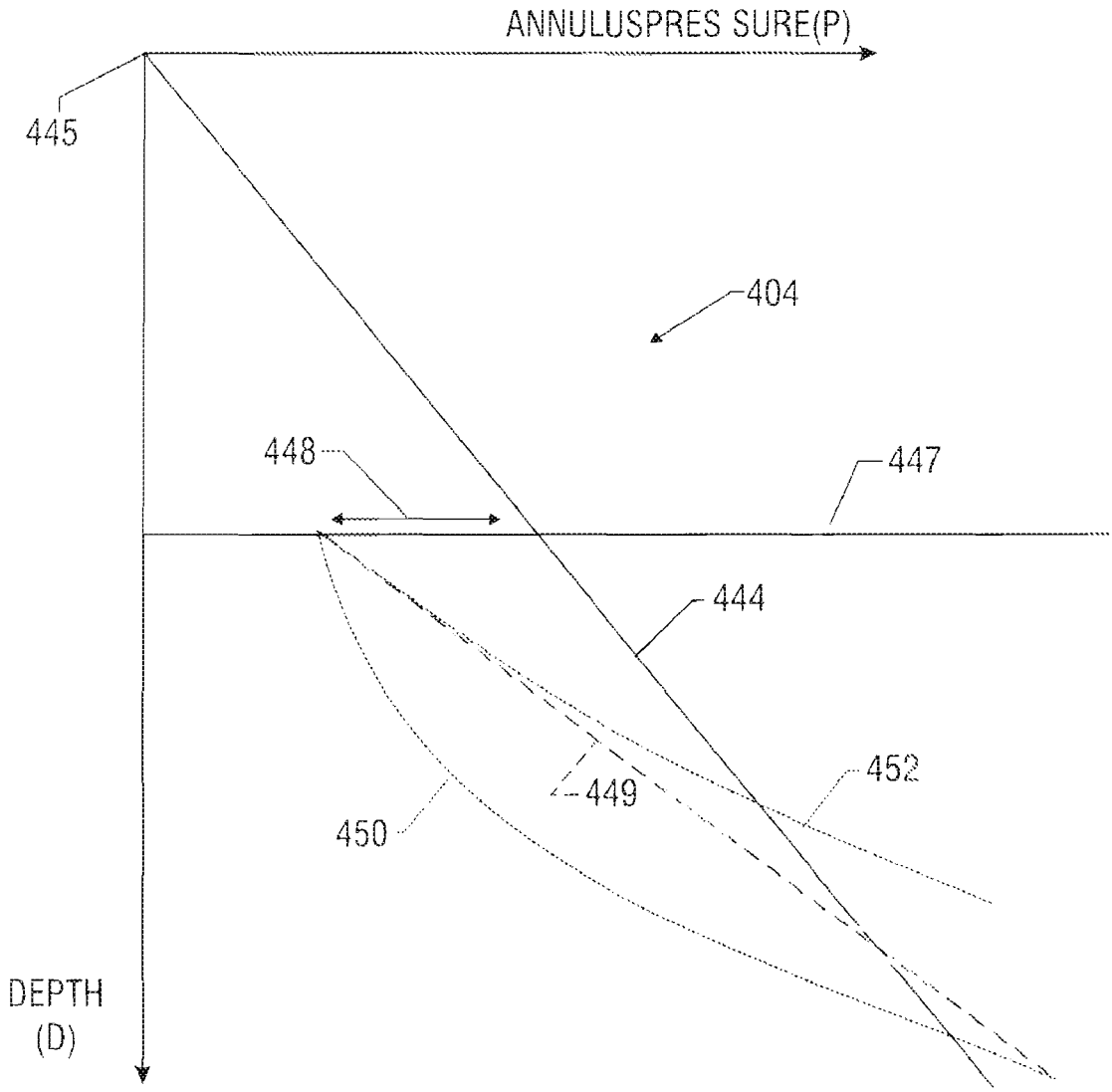
FIG. 10B graphically illustrates the operational influence of the FIG. 10A embodiment on annulus pressure during reverse circulation.

An illustrative pressure gradient for the system 420 is shown in FIG. 10B, which has an illustrative graph 440 having annulus pressure P along the abscissa and depth D along the ordinate. For illustrative purposes, a pressure gradient curve associated with a drilling fluid column along the supply line 426 extending to the surface 445 is shown with numeral 444. As should be appreciated, a pressure reduction shown by numeral 448 is obtained by moving the drilling fluid supply 422 from the surface to a subsea depth 447, such as the sea floor. Thus, the drilling fluid column in this arrangement extends into the subsea wellbore from the depth 447. The pressure gradient curve for this relatively shorter drilling fluid column is shown with numeral 449 and can have an initial pressure value at depth 447 of the surrounding water hydrostatic pressure or some other selected pressure. The pressure gradient curve 449 can be shifted, if needed, to remain generally within a pore pressure 450 and a fracture pressure 452 of the formation, although this need not necessarily be the case. The pressure gradient curve 449 can also be adjusted or controlled to provide an at-balanced or an underbalanced condition.

In certain situations, it may be desirable to drill in an underbalanced condition; i.e., the wellbore annulus pressure being below a pore pressure of the formation. Such situations may arise in both land and offshore wells. In aspects, the teachings of the present disclosure relate to controlling annular pressure during drilling to create an underbalanced condition in the wellbore during reverse circulation.

Figure 11A:
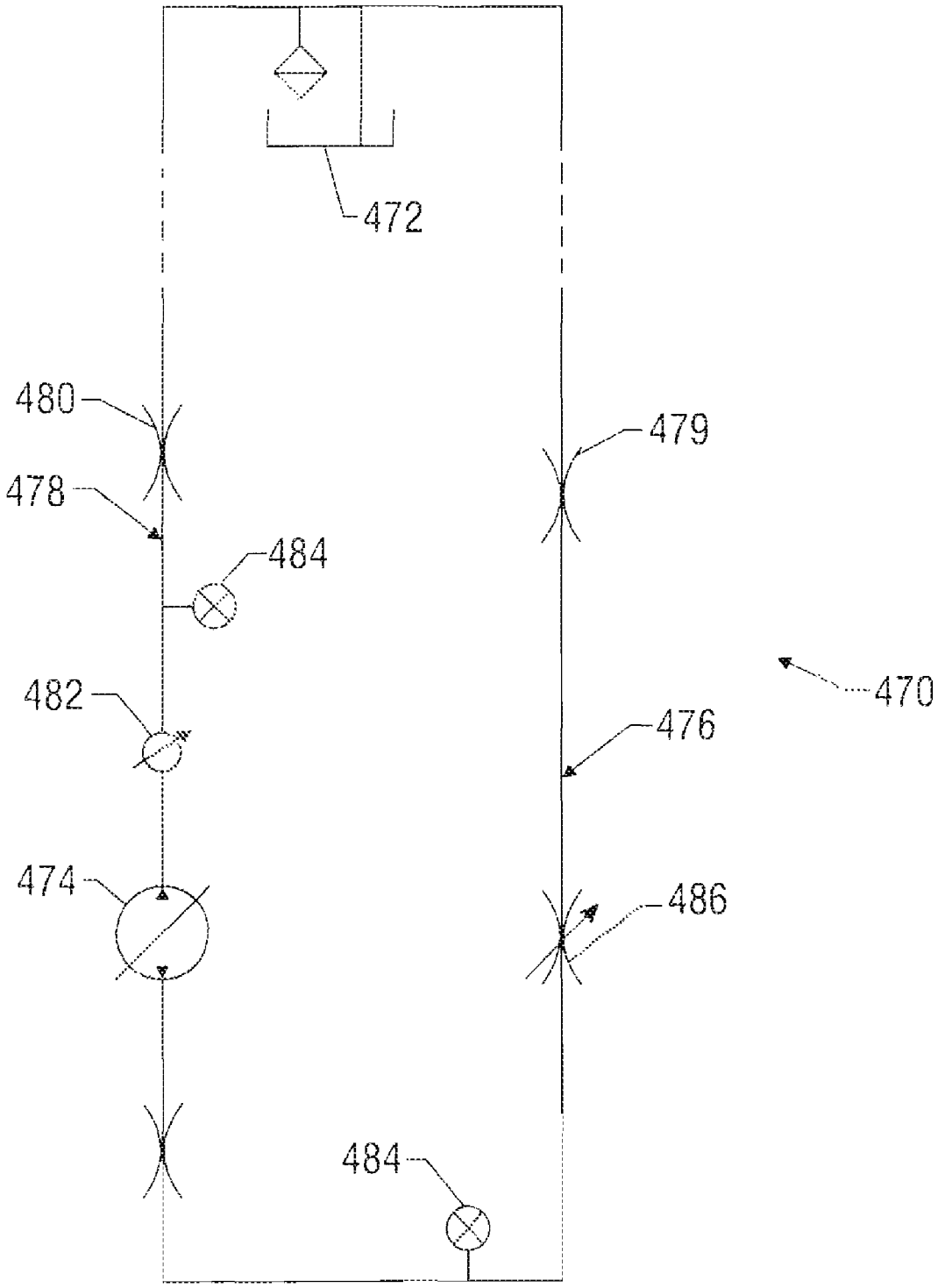
FIG. 11A is a schematic illustration of an embodiment of an arrangement according to the present disclosure for reverse circulation in an underbalanced state.

Referring now to FIG. 11A, there is schematically shown an embodiment of a reverse circulation system 470 suitable for underbalanced drilling operations. The system 470 includes a surface drilling fluid supply 472 and a downhole fluid circulation device 474. The fluid circulation device 474 can be of any type previously described and in some embodiments has bi-directional flow; i.e., pump fluid uphole and downhole. The system 470 can be located on land, at a sea floor or an offshore platform. Drilling fluid flows into the wellbore via a supply line 476 and returns via a return line 478. The supply line 476 includes an annulus 479 of a wellbore. The return line 478 can be formed at least partially of a drilling tubular 480. Additional devices include previously discussed devices such as a return line flow control device 482 and sensors 484 such as pressure sensors.

To control annulus pressure, a supply line flow control device 486 is positioned along the supply line 476, e.g., at the surface, in a riser, at a sea floor or as shown in the annulus 479 of the wellbore. The flow control device 486 selectively restricts the flow through the supply line 476 and can be of embodiments previously described. Since the flow control device 486 can be positioned in the wellbore, the flow control device 486 can include a seal member (not shown) to seal off the annular space between a drill string and the wellbore wall, liner wall, casing wall or other adjacent structure. Such a seal may be needed to allow the flow control device 486 to control flow. The flow control device 486 can be fixed in a stationary location or attached to the drill string via a device such as a non-rotating sleeve. The fluid circulation device 474 is configured as progressive cavity pump or other suitable device that maintains a selected flow rate while the flow control device 486 restricts flow. The combined operation of the fluid circulation device 474 and the flow control device 486 reduces pressure downhole of the flow control device 486. In one arrangement, the flow control device 486 selectively reduces the cross-sectional flow area in the supply line. In response, to maintain the selected fluid flow circulation rate, the pressure differential across the fluid circulation device 474 increases in magnitude. The increased pressure differential across the fluid circulation device 474 is seen as a drop in pressure downhole of the flow control device 486. Thus, the annular wellbore pressure, can be adjusted by controlling operation of the control device 486 and/or the fluid circulation device 474.

Figure 11B:
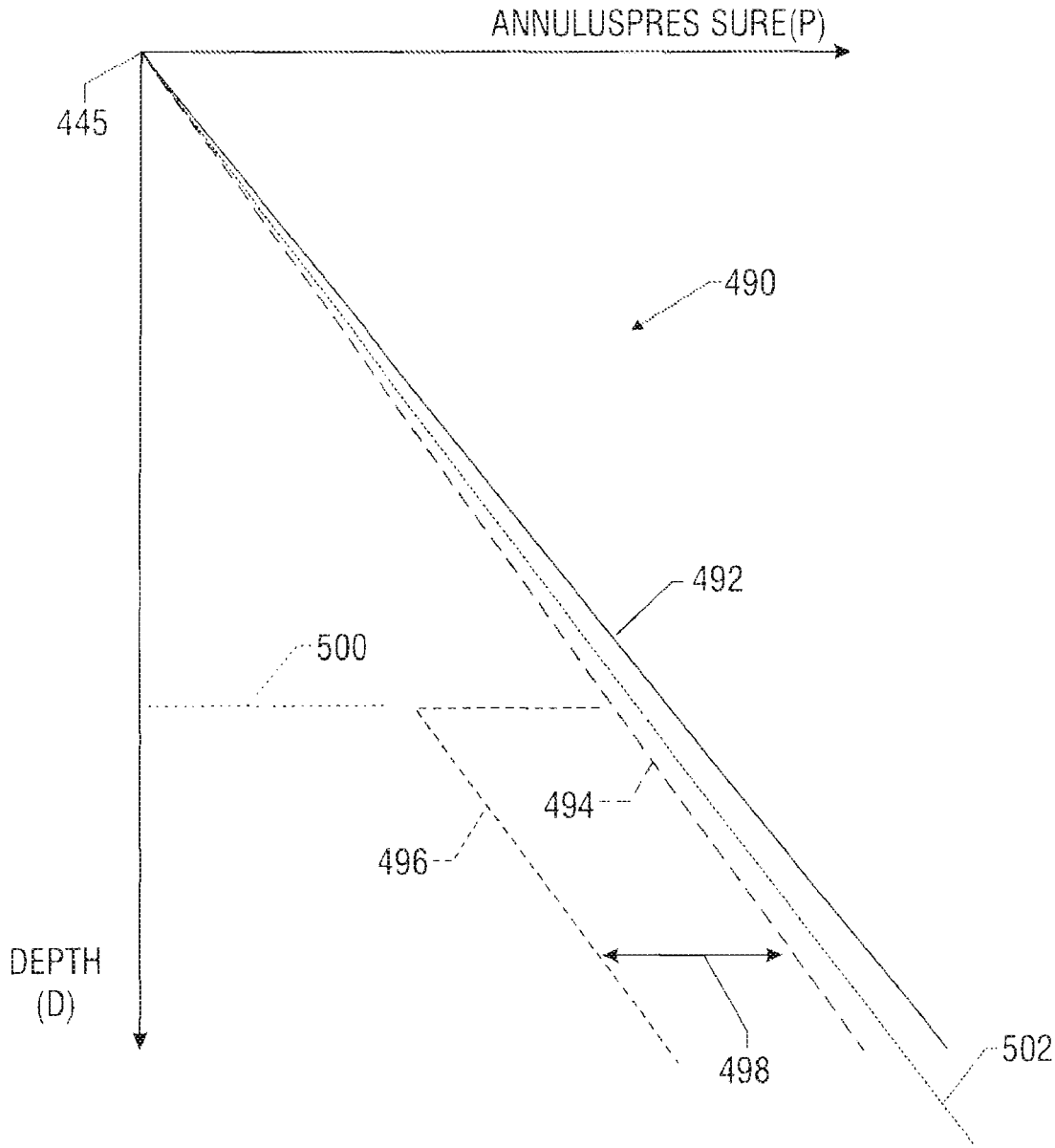
FIG. 11B graphically illustrates the operational influence of the FIG. 11A embodiment on annulus pressure during reverse circulation.

An illustrative pressure gradient for the system 470 is shown in FIG. 11B, which has an illustrative graph 490 having annulus pressure P along the abscissa and depth D along the ordinate. Shown on graph 490 is an exemplary formation pore pressure curve 502. A pressure gradient curve 492 shows the pressure along the supply line 476 if there is no circulation in the wellbore and the flow control device 486 is not operational. As can be seen, the pressure gradient curve 492 is generally hydrostatic pressure. If fluid is circulating, then circulating pressure losses cause a pressure gradient curve 494, which results in lower wellbore pressure relative to the curve 492. When activated, the flow control device 486 positioned at a depth 500 in the wellbore restricts flow, which causes a further pressure drop shown with numeral 498 at the depth 500 in a manner previously described. In one arrangement, the pressure drop 498 is selected so that the controlled pressure gradient curve 496 remains generally below the pore pressure 502. More generally, the magnitude of the pressure drop 498 can be controlled by appropriate selection of operating parameters for the control device 486 and/or the fluid circulation device 474.

Figure 12A:
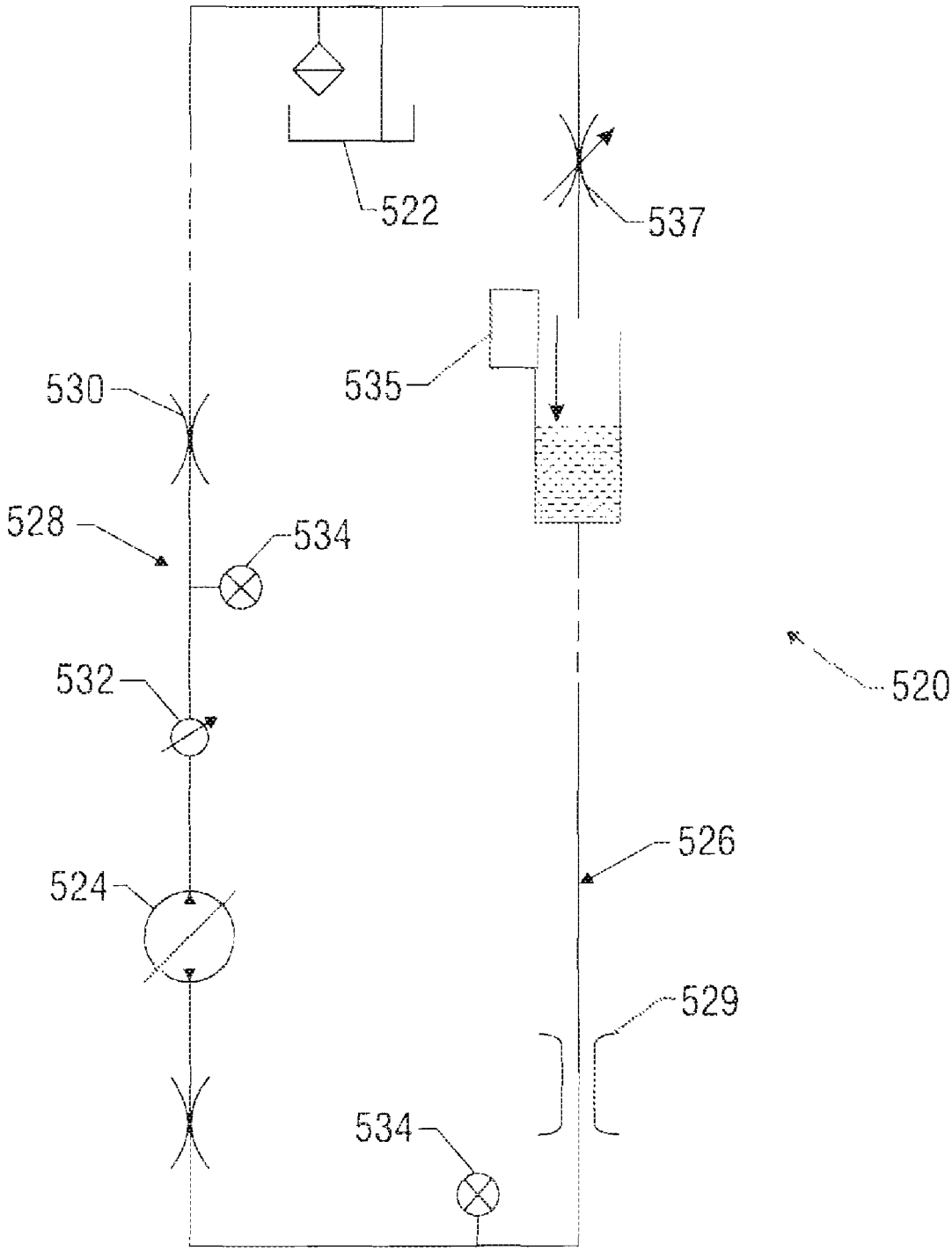
FIG. 12A is a schematic illustration of another embodiment of an arrangement according to the present disclosure for reverse circulation in an underbalanced state.

Referring now to FIG. 12A, there is schematically shown another embodiment of a reverse circulation system 520 adapted for underbalanced drilling operations. The system 520 includes a drilling fluid supply 522 and a downhole fluid circulation device 524. The fluid circulation device 524 can be of any type previously described and in some embodiments has bi-directional flow; i.e., pump fluid uphole and downhole. The fluid supply 522 can be situated on land, on an offshore platform such as a drill ship or at a sea floor. Drilling fluid flows into the wellbore via a supply line 526 and returns via a return line 528. The supply line 526 can include a riser portion (not shown) as well as an annulus 529 of the wellbore. The return line 528 can be formed at least partially of a drilling tubular 530. Additional devices include previously discussed devices such as a return line flow control device 532 and sensors 534 such as pressure sensors. Devices such as a level meter 535 can be coupled to the supply line 526 to provide an indication of flow therein. For instance, the level meter 535 can be utilized to distinguish between an obstruction in the annulus and low drilling fluid level. During operation, the fluid circulation device 524 initiates and controls the flow circulation in the system 520. To cause or induce an underbalanced condition in the wellbore, the system 520 uses a supply choke 537 or other flow control device to selectively flow fluid into the supply line 526, which then controls the height of the drilling fluid column in the supply line 526. As discussed in connection with FIG. 8A, a fluid column creates a hydrostatic head that varies directly with the height of the fluid column. Thus, drilling fluid is supplied into the supply line 526 at a rate or in an amount to form a drilling fluid column having a height that causes a selected annular pressure in the wellbore.

Figure 12B:
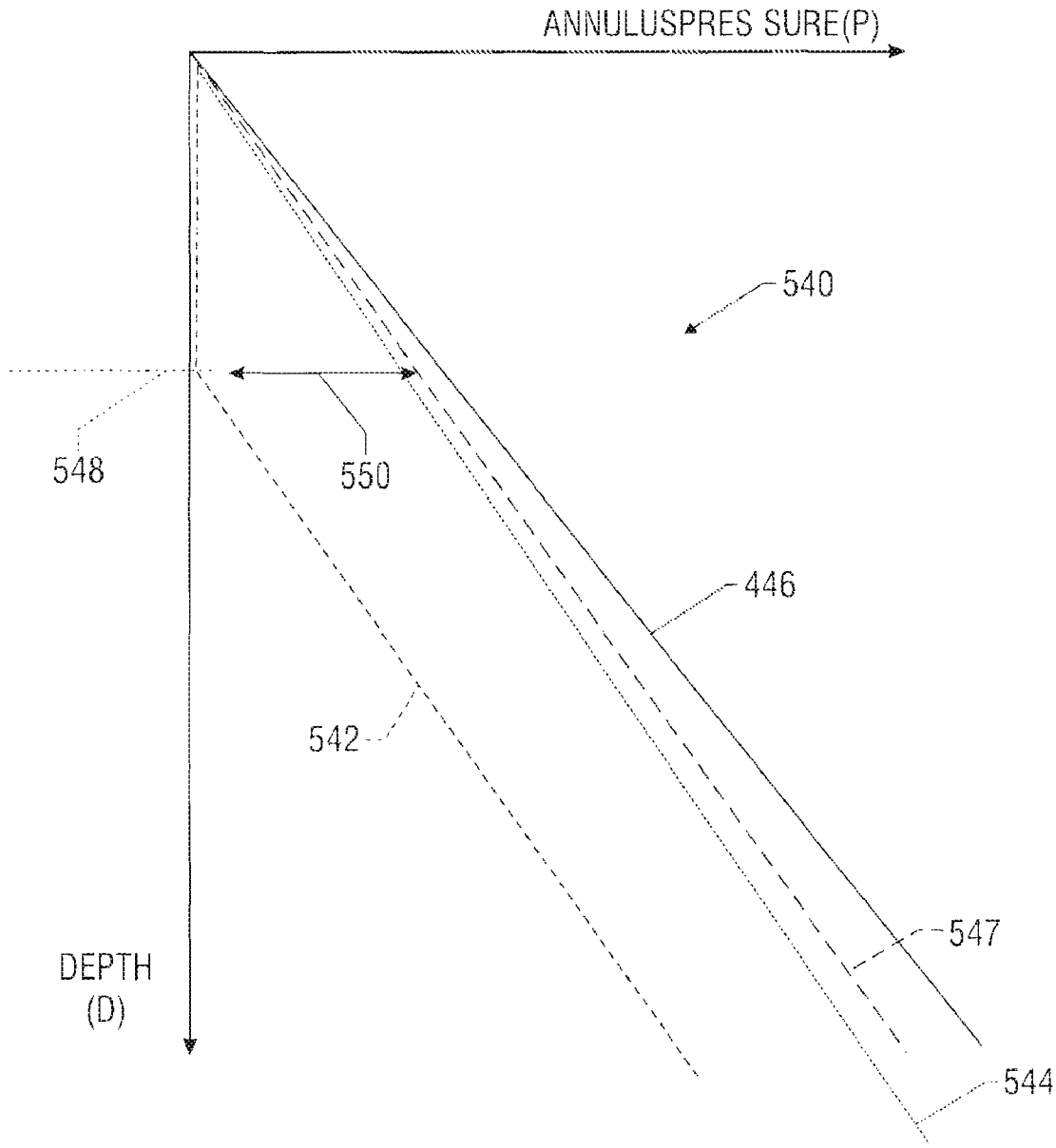
FIG. 12B graphically illustrates the operational influence of the FIG. 12A embodiment on annulus pressure during reverse circulation.

An illustrative pressure gradient for the system 520 is shown in FIG. 12B, which has an illustrative graph 540 having annulus pressure P along the abscissa and depth D along the ordinate. The pressure gradient curve along the supply line 526 is shown with numeral 542. Also shown on graph 540 is an exemplary formation pore pressure curve 544 and, for illustrative purposes, a pressure gradient curve 546 associated with a drilling fluid column extending to a surface location. Curve 547 represents a pressure gradient curve for reverse circulation without modification to the supply of drilling fluid. As can be seen, the operational influence of a selectively filled supply line 526 is a reduction in annular pressure reflected in a shifting of the pressure gradient curve 546 to the left. Thus, at a selected arbitrary depth 548, the amount of pressure reduction is shown with numeral 550. That is, depth 548 can be considered the top of the drilling fluid column and thus the depth 548 is controlled by operating the supply choke 537, which controls the height of the fluid column and associated hydrostatic head.

While certain features of the present disclosure may have been uniquely described in one embodiment discussed above, it should be understood that such features may be readily applied in other arrangements. Moreover, the control devices and drilling systems discussed in relation to FIGS. 2 to 5 above can readily be used in conjunction with the devices, systems and methodologies discussed in FIGS. 6 to 12. For example, the controller 170 discussed in FIG. 3 can be used to control any of the devices and shown in FIGS. 6 to 12. Thus, the systems of FIGS. 6 to 12 can be configured to be automated using appropriate processors and communication links.

Additionally, it should be appreciated that the present teachings are in many respects directed to drawbacks with reverse circulation techniques in general and, therefore, are not limited to any particular reverse circulation system or device described above. Indeed, the teachings of the present disclosure may be readily and advantageously applied to conventional reverse circulating systems. Further still, while the present teachings have been described in the context of drilling, these teachings may also be readily and advantageously applied to other well construction activities such as running wellbore tubulars, completion activities, perforating activities, etc. That is, the present teachings can have utility in any instance where fluid, not necessarily drilling fluid, is reverse circulated in the wellbore.

It should be understood that the graphs described above are intended merely to illustrate the utility of the present disclosure and not represent actual measured values.

While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method for reverse circulating a drilling fluid in a wellbore, comprising:

supplying drilling fluid into the wellbore via at least an annulus of the wellbore;

returning the drilling fluid to a surface location via at least a bore of a tubular;

increasing a pressure in the circulating returning fluid using an Active Pressure Differential Device (APD Device) in the wellbore;

flowing the drilling fluid from the annulus into the tubular via a second APD device in the wellbore;

varying a pressure in the circulating drilling fluid using the second APD Device; and controlling the second APD Device using a selected formation parameter.

2. The method according to claim 1, further comprising:

estimating a circulating pressure loss; and increasing the pressure in the drilling fluid supplied into the annulus of the wellbore to at least partially offset the circulating pressure loss.

3. The method according to claim 1 wherein the second APD Device increases the pressure in drilling fluid supplied into the annulus of the wellbore to at least a pore pressure of a formation intersected by the wellbore.

4. The method according to claim 1 wherein the selected formation parameter is one of (i) a pore pressure of a formation intersected by the wellbore, and (ii) a fracture pressure of a formation intersected by the wellbore.

5. The method according to claim 4 further comprising: supplying a fluid to the wellbore via a riser; and adjusting a height of the fluid in the riser to decrease the pressure in the annulus of the wellbore.

6. The method according to claim 4 further comprising: positioning a fluid supply at a selected subsea location; and supplying the fluid into the wellbore from the fluid supply.

7. The method according to claim 1 further comprising: determining a pore pressure of a formation intersected by the wellbore; and selecting a weight for the drilling fluid that causes a wellbore pressure greater than the determined pore pressure during fluid circulation.

8. The method of claim 1, wherein the APD Device is bi-directional.

9. A system for circulating a fluid in a wellbore wherein the fluid flows into the wellbore at least via a wellbore annulus and returns to the surface via at least a bore of a wellbore tubular, the system comprising:

a fluid circulation device in a fluid returning to the surface, the fluid circulation device providing the primary motive force for flowing the fluid to the surface;

a flow control device in the wellbore conveying fluid from the annulus into the wellbore tubular, the flow control device being configured to control a flow of fluid circulating through the wellbore annulus and through the fluid circulation device to control pressure in the wellbore; and a controller configured to control the flow control device using a selected formation parameter.

10. The system of claim 9 wherein the flow control device is an active pressure differential device that increases a pressure in the fluid flowing in the annulus to at least partially offset a circulating pressure loss caused by operation of the fluid circulation device.

11. The system of claim 9 further comprising: a fluid supply positioned at a selected subsea location that supplies the drilling fluid.

12. The system of claim 9 further comprising: a riser supplying a fluid to the wellbore, wherein the flow control device adjusts a height of the fluid in the riser to decrease the pressure in the annulus of the wellbore.

13. The system of claim 9 wherein the fluid circulation device is a pump and the flow control device is a pump.

14. The system of claim 9, wherein the fluid circulation device is bi-directional.

* * * * *